US010446092B2

(12) United States Patent
Aragane et al.

(10) Patent No.: US 10,446,092 B2
(45) Date of Patent: Oct. 15, 2019

(54) IMAGE PROCESSING APPARATUS, DISPLAY APPARATUS, IMAGE PROCESSING METHOD, AND IMAGE PROCESSING PROGRAM

(71) Applicant: Dai Nippon Printing Co., Ltd., Tokyo (JP)

(72) Inventors: Kuniaki Aragane, Tokyo (JP); Kenji Masuda, Tokyo (JP); Kenichi Matsumura, Tokyo (JP)

(73) Assignee: Dai Nippon Printing Co., Ltd., Shinjuku-Ku (JP)

( * ) Notice: Subject to any disclaimer, the term of this patent is extended or adjusted under 35 U.S.C. 154(b) by 10 days.

(21) Appl. No.: 14/900,415

(22) PCT Filed: May 28, 2014

(86) PCT No.: PCT/JP2014/064106
§ 371 (c)(1),
(2) Date: Dec. 21, 2015

(87) PCT Pub. No.: WO2014/208254
PCT Pub. Date: Dec. 31, 2014

(65) Prior Publication Data

US 2016/0140913 A1 May 19, 2016

(30) Foreign Application Priority Data

Jun. 24, 2013 (JP) ..... 2013-132127
May 9, 2014 (JP) ..... 2014-098160

(51) Int. Cl.
*G09G 3/34* (2006.01)
*G09G 5/02* (2006.01)

(52) U.S. Cl.
CPC ..... *G09G 3/3413* (2013.01); *G09G 3/3406* (2013.01); *G09G 5/02* (2013.01); *G09G 2320/0666* (2013.01); *G09G 2330/04* (2013.01)

(58) Field of Classification Search
CPC ..... G09G 2320/0666; G09G 2330/04; G09G 3/3406; G09G 3/3413; G09G 5/02
See application file for complete search history.

(56) References Cited

U.S. PATENT DOCUMENTS 5,167,228 A * 12/1992 Czeisler ..... A61M 21/00 607/88
5,304,212 A * 4/1994 Czeisler ..... A61M 21/00 607/88

(Continued)

FOREIGN PATENT DOCUMENTS

CN 101558440 A 10/2009
CN 102414733 A 4/2012

(Continued)

OTHER PUBLICATIONS

Chinese Office Action (Application No. 201480035809.6) dated Oct. 28, 2016.

(Continued)

*Primary Examiner* — Michael J Jansen, II
(74) *Attorney, Agent, or Firm* — Burr & Brown, PLLC

(57) ABSTRACT

An image processing apparatus that can protect user's eyes by reducing harmful blue light in a mode that matches the characteristics of an image to be displayed and the preference of the user who causes the image to be displayed. The image processing apparatus includes a blue light reduction control unit that acquires image information Sin corresponding to an image to be displayed on a display and a pixel value update unit that generates update image information Sbc by reducing at least luminance corresponding to a blue com- (Continued)

ponent in the acquired image information Sin so that a reduction rate of the luminance corresponding to the blue component is greater than or equal to reduction rates of luminance corresponding to the other color components in the acquired image information Sin and outputs the update image information Sbc to the display to cause the display to display the update image information Sbc.

14 Claims, 17 Drawing Sheets

(56) References Cited

U.S. PATENT DOCUMENTS 6,053,936 A * 4/2000 Koyama ..... A61M 21/00 600/27
6,579,233 B2 * 6/2003 Hursh ..... A61B 5/4809 600/300
6,690,351 B1 * 2/2004 Wong ..... G06F 1/163 345/156
7,154,468 B2 * 12/2006 Linzmeier ..... G09G 3/3406 345/102
7,207,938 B2 * 4/2007 Hursh ..... A61B 5/4809 600/300
7,234,814 B2 * 6/2007 Morita ..... H05B 39/042 351/203
7,580,033 B2 * 8/2009 Plut ..... G06F 1/3218 345/211
7,710,388 B2 * 5/2010 Hirata ..... G09G 3/2003 345/103
8,032,317 B2 * 10/2011 Houston ..... G01R 22/10 702/62
8,120,670 B2 * 2/2012 Kwon ..... H04N 9/735 348/223.1
8,184,132 B2 * 5/2012 Sakamoto ..... G06F 3/011 345/156
8,373,644 B2 * 2/2013 Koike ..... G09G 3/3426 345/102
8,378,574 B2 * 2/2013 Schlangen ..... A61M 21/00 313/485
8,378,960 B2 * 2/2013 Kangas ..... G09G 3/3406 345/102
8,441,498 B2 * 5/2013 Lammers ..... G09G 5/02 345/589
8,451,391 B2 5/2013 Ueki et al.
8,493,316 B2 * 7/2013 Shabel ..... G06F 1/3203 345/102
8,537,174 B2 * 9/2013 Capener ..... G09G 5/10 345/589
8,570,351 B2 * 10/2013 Mori ..... G09G 3/3607 345/690
8,605,127 B2 * 12/2013 Yang ..... G09G 3/003 345/694
8,610,659 B2 * 12/2013 Fletcher ..... G06F 1/3203 345/102
8,643,680 B2 * 2/2014 Baldwin ..... G06F 3/013 345/684
8,680,518 B2 * 3/2014 Kim ..... H01L 27/3213 257/40
8,706,911 B2 * 4/2014 You ..... G06F 1/3203 709/246
8,730,275 B2 * 5/2014 Mori ..... G09G 3/20 345/204
8,736,641 B2 * 5/2014 Byun ..... G09G 3/3208 345/690
8,743,099 B2 * 6/2014 Lin ..... G09G 5/00 345/102
8,810,413 B2 * 8/2014 Wong ..... G06F 3/011 340/573.1
8,836,906 B2 * 9/2014 Kurokawa ..... G02F 1/1339 349/138
8,957,847 B1 * 2/2015 Karakotsios ..... G06F 3/013 345/156
9,035,980 B2 * 5/2015 Yang ..... G09G 3/3225 345/694
9,064,450 B2 * 6/2015 Kashiwabara ..... G09G 3/2003
9,094,539 B1 * 7/2015 Noble ..... H04N 7/00
9,214,010 B2 * 12/2015 Kawaguchi ..... G06T 5/00
9,406,277 B1 * 8/2016 Letourneur ..... G09G 5/10
9,728,123 B2 * 8/2017 Kim ..... G09G 3/3233
9,805,676 B2 * 10/2017 Koyama ..... G09G 3/3655
2002/0008696 A1 * 1/2002 Wagner ..... G09G 3/3406 345/204
2003/0013943 A1 * 1/2003 Hursh ..... A61B 5/4809 600/300
2003/0038815 A1 * 2/2003 Tsai ..... G09G 1/285 345/589
2005/0052446 A1 * 3/2005 Plut ..... G06F 1/3218 345/211
2005/0094098 A1 * 5/2005 Morita ..... H05B 39/042 351/203
2005/0110740 A1 * 5/2005 Linzmeier ..... G09G 3/3406 345/102
2005/0168423 A1 * 8/2005 Hirata ..... G09G 3/2003 345/88
2005/0177031 A1 * 8/2005 Hursh ..... A61B 5/4809 600/300
2006/0152525 A1 * 7/2006 Woog ..... G09G 5/003 345/589
2006/0209004 A1 * 9/2006 Nagai ..... G09G 3/3413 345/102
2007/0268234 A1 * 11/2007 Wakabayashi ..... A61M 21/00 345/102
2008/0117323 A1 * 5/2008 Sakamoto ..... G06F 3/011 348/333.01
2008/0224968 A1 * 9/2008 Kashiwabara ..... G09G 3/2003 345/83
2009/0172430 A1 * 7/2009 Takenouchi ..... G06F 1/3203 713/310
2009/0278828 A1 * 11/2009 Fletcher ..... G06F 1/3203 345/207
2009/0281604 A1 * 11/2009 De Boer ..... A61M 21/00 607/88
2009/0287433 A1 * 11/2009 Houston ..... G01R 22/10 702/62
2010/0013952 A1 * 1/2010 Kwon ..... H04N 9/735 348/223.1
2010/0020242 A1 * 1/2010 Lammers ..... G09G 5/02 348/642
2010/0073276 A1 * 3/2010 Koike ..... G09G 3/3426 345/102
2010/0171441 A1 * 7/2010 Schlangen ..... A61M 21/00 315/294
2010/0225673 A1 * 9/2010 Miller ..... G09G 3/2003 345/690
2010/0264850 A1 * 10/2010 Yamamoto ..... G09G 5/14 315/312
2011/0037781 A1 * 2/2011 Kangas ..... G09G 3/3406 345/690
2011/0080421 A1 * 4/2011 Capener ..... G09G 5/10 345/589
2011/0185205 A1 * 7/2011 You ..... G06F 1/3203 713/320
2011/0227966 A1 * 9/2011 Mori ..... G09G 3/20 345/690
2011/0254759 A1 * 10/2011 Mori ..... G09G 3/3607 345/88
2011/0260958 A1 * 10/2011 Shabel ..... G06F 1/3203 345/102
2011/0261308 A1 * 10/2011 Kurokawa ..... G02F 1/13338 349/138
2012/0092172 A1 * 4/2012 Wong ..... G06F 3/011 340/575
2012/0105517 A1 * 5/2012 Yang ..... G09G 3/003 345/694
2012/0112991 A1 * 5/2012 Hashimoto ..... G09G 3/3413 345/89

(56) References Cited

U.S. PATENT DOCUMENTS

2012/0147065 A1* 6/2012 Byun ..... G09G 3/3208 345/690
2012/0218282 A1* 8/2012 Choboter ..... G09G 5/00 345/589
2012/0256967 A1* 10/2012 Baldwin ..... G06F 3/013 345/684
2013/0070006 A1* 3/2013 Yang ..... G09G 3/3225 345/694
2013/0082991 A1* 4/2013 Lin ..... G09G 5/00 345/207
2013/0105778 A1* 5/2013 Kim ..... H01L 27/3213 257/40
2013/0120431 A1* 5/2013 Kawaguchi ..... G06T 5/00 345/590
2013/0169543 A1* 7/2013 Xia ..... G09G 3/003 345/169
2013/0222913 A1 8/2013 Tomoda et al.
2014/0063853 A1* 3/2014 Nichol ..... G02B 6/0028 362/616
2014/0104151 A1* 4/2014 Yamazaki ..... G09G 3/3659 345/94
2014/0146033 A1* 5/2014 Koyama ..... G09G 3/3655 345/212
2014/0152685 A1* 6/2014 Iwaki ..... G09G 3/2007 345/589
2014/0176620 A1* 6/2014 Yano ..... G09G 3/3208 345/690
2014/0184484 A1* 7/2014 Miyake ..... G09G 3/3677 345/87
2015/0009194 A1* 1/2015 Kim ..... G09G 3/3233 345/211
2016/0148553 A1* 5/2016 Ryo ..... G09G 3/20 345/593

FOREIGN PATENT DOCUMENTS

EP 2 172 925 A1 4/2010
JP 2005-309360 4/2005
JP 2006-231057 A1 9/2006
JP 2008-092481 A1 4/2008
JP 2013-008052 A1 1/2013
JP 2013-257457 A1 12/2013
WO 2012/176685 A1 12/2012

OTHER PUBLICATIONS

Japanese Office Action and English translation (Application No. 2015-153663) dated Aug. 23, 2016, 5 pages.
International Search Report (Application No. PCT/JP2014/064106) dated Aug. 26, 2014.
Extended European Search Report (Application No. 14818747.9) dated Jan. 18, 2017.
Japanese Office Action (Application No. 2016-207703) dated Aug. 22, 2017 (with English translation).
European Office Action, European Application No. 14818747.9, dated Dec. 6, 2018 (14 pages).
European Office Action, European Application No. 17186213.9, dated Dec. 6, 2018 (14 pages).

* cited by examiner (a)

(b)

(a)

(b)

(a)

(b)

(a)

(b)

(a)

(b)

(a)

(b)

(a)

(b)

(a)

(b)

(a)

(b)

(a)

(b)

(a)

(b)

IMAGE PROCESSING APPARATUS, DISPLAY APPARATUS, IMAGE PROCESSING METHOD, AND IMAGE PROCESSING PROGRAM

BACKGROUND OF THE INVENTION

1. Field of the Invention

The present invention relates to a technical field of an image processing apparatus, a display apparatus, an image processing method, and an image processing program. More specifically, the present invention relates to a technical field of an image processing apparatus, a display apparatus, an image processing method, and a program for the image processing apparatus for protecting eyes of a user who sees a displayed image.

2. Description of Related Art

In recent years, an LED (Light Emitting Diode) is actively employed as a backlight of a personal computer and a tablet type terminal apparatus. The LED strongly emits light in a blue color region in a visible light ray and the energy of the light is strong, so that it is said that the light causes damage of retina or the like of eyes of a user. To improve the problem, an optical component effective to reduce a feeling of fatigue and prevent eye disease is proposed. Patent Document 1 described below is an example of Patent document that discloses such an optical component which has an antiglare effect, is effective to reduce a feeling of fatigue and prevent eye disease, and has excellent visibility.

The optical component disclosed in Patent Document 1 realizes the antiglare effect, the reduction of a feeling of fatigue, and the prevention of eye disease by reducing light of a specific wavelength range (hereinafter simply referred to as "blue light", of which wavelength is about 400 nanometer to 500 nanometer). The optical component is configured to reduce the blue light emitted into eyes by attaching the optical component to a display apparatus (or by attaching the optical components having a lens shape to eyeglasses and seeing an object through the lenses).

CITATION LIST

Patent Document

Patent Document Japanese Patent Application Laid-open No. 2013-8052

SUMMARY OF THE INVENTION

Problem to be Solved by the Invention

However, in a case of reducing only the blue light by using the optical component disclosed in Patent Document 1 described above, of course, the color of a displayed image is seen as a different color, so that there is a problem that sharpness of the entire image is lost. Therefore, it is desired to satisfy both of a case where the sharpness is desired to be maintained according to content of the image itself and a situation where the image is seen (a case where the blue light is not desired to be reduced) and a case where the blue light is desired to be reliably reduced.

However, in a case where the optical component disclosed in the Patent Document 1 is used, it is difficult to appropriately control ON/OFF of the reduction of the blue light because it is difficult to frequently replace the optical component according to the situation. In a case where the blue light is reduced by the optical component, the blue light is uniformly reduced regardless of the image itself, so that it is impossible to perform ON/OFF control of the reduction of the blue light associated with content of the image and the like. Further, the reduction rate of the blue light of the optical component itself is fixed by material of the optical component, so that there is a problem that the reduction rate cannot be arbitrarily changed according to a reduction rate required by a user.

Therefore, the present invention is made in view of the above problem, and an example of the object of the present invention is to provide an image processing apparatus, a display apparatus, an image processing method, and a program for the image processing apparatus, which can protect user's eyes by reducing harmful blue light in a mode that matches the characteristics of an image to be displayed and the preference of the user who causes the image to be displayed.

Means for Solving the Problem

In order to achieve the above object, a first aspect of the invention comprises: an acquisition means such as a blue light reduction control unit that acquires image information corresponding to an image to be displayed on a display means such as a display; and a processing means such as a pixel value update unit that performs luminance control processing that generates display image information by reducing at least luminance corresponding to a blue component in the acquired image information so that a reduction rate of the luminance corresponding to the blue component in the acquired image information is greater than or equal to reduction rates of luminance corresponding to the other color components in the acquired image information and outputs the display image information to the display means to cause the display means to display the display image information.

According to a second aspect of the present invention, the image processing apparatus according to the first aspect is provided, wherein the blue component is a B component in an RGB (Red Green Blue) color space and the other color components are an R component and a G component in the RGB color space, and the processing means generates the display image information by reducing the luminance corresponding to the B component so that the reduction rate of the luminance corresponding to the B component is greater than the reduction rates of the luminance respectively corresponding to the R component and the G component and outputs the display image information to the display means to cause the display means to display the display image information.

According to the second aspect of the present invention, in addition to the function according to the first aspect, the display image information is generated and displayed by reducing the luminance corresponding to the B component so that the reduction rate of luminance corresponding to the B component in the RGB color space is greater than each of the reduction rates of luminance corresponding to the R component and the G component, respectively, in the RGB color space. Therefore, it is possible to reduce the harmful blue component without separately using an optical member or the like that reduces the B component.

According to a third aspect of the present invention, the image processing apparatus according to the second aspect is provided, wherein as the luminance control processing, the processing means generates the display image information by setting, the greater the B component in a pixel included in the image is than the R component and the G component in the pixel, the greater the reduction rate of the luminance corresponding to the B component.

According to the third aspect of the present invention, in addition to the function according to the second aspect, the display image information is generated by setting, the greater the B component in a pixel comprised in the image is than the R component and the G component in the pixel, the greater the reduction rate of luminance corresponding to the B component. Therefore, the greater the B component in a pixel, the greater the B component that is reduced, so that by reducing the B component considering the balance between the R, G, and B components, it is possible to reduce the harmful blue component while preventing the color tone of the entire image from being changed.

According to a fourth aspect of the present invention, the image processing apparatus according to the second or third aspects is provided, wherein as the luminance control processing, the processing means generates the display image information by setting the reduction rates of the luminance respectively corresponding to the R component and the G component to be greater than or equal to a quarter and smaller than or equal to a half of the reduction rate of the luminance corresponding to the B component.

According to the fourth aspect of the present invention, in addition to the function according to the second or third aspects, the reduction rate corresponding to each of the R component and the G component is set to be greater than or equal to a quarter of the reduction rate corresponding to the B component and smaller than or equal to a half of the reduction rate corresponding to the B component. Therefore, it is possible to reduce the harmful blue component while preventing the change of color tone of the entire image by reducing the R component and the G component while considering the balance with the B component.

According to a fifth aspect of the present invention, the image processing apparatus according to the first aspect is provided, wherein the blue component is a B component in hue in a color space including three elements including the hue, and saturation and the other color components are color components other than the B component in the hue, and the processing means generates the display image information by reducing the luminance corresponding to the B component so that the reduction rate of the luminance corresponding to the B component is greater than or equal to the reduction rates of the luminance corresponding to the color components other than the B component in the hue and outputs the display image information to the display means to cause the display means to display the display image information.

According to the fifth aspect of the present invention, in addition to the function according to the first aspect, the display image information is generated and displayed by reducing the luminance corresponding to the B component so that the reduction rate corresponding to the B component in the hue in a color space including three elements including the hue and the saturation is greater than or equal to the reduction rate of luminance corresponding to each color component other than the B component in the hue in the color space. Therefore, it is possible to reduce the harmful blue component without separately using an optical member or the like that reduces the B component.

According to a sixth aspect of the present invention, the image processing apparatus according to the fifth aspect is provided, wherein as the luminance control processing, the processing means generates the display image information by setting all the reduction rates of the luminance respectively corresponding to the B component in the hue and the color components other than the B component in the hue to be the same.

According to the sixth aspect of the present invention, in addition to the function according to the fifth aspect, the display image information is generated by setting all the reduction rates of luminance corresponding to the B component in the hue and the color components other than the B component in the hue to be the same. Therefore, all the color components are evenly reduced, so that, for example, it is possible to reduce the B component while preventing color tone of white color on display from being changed and it is possible to reduce the harmful blue component without change of color tone.

According to a seventh aspect of the present invention, the image processing apparatus according to the fifth aspect is provided, wherein when an image corresponding to the acquired image information is achromatic color, as the luminance control processing, the processing means generates the display image information by reducing only an element other than the hue and the saturation in the color space.

According to the seventh aspect of the present invention, in addition to the function according to the fifth aspect, in a case where an image corresponding to the acquired image information is achromatic color, the display image information is generated by reducing only an element other than the hue and the saturation in the color space, so that even in a case where the image is achromatic color, it is possible to protect user's eyes.

According to an eighth aspect of the present invention, the image processing apparatus according to the fifth aspect is provided, wherein as the luminance control processing, the processing means generates the display image information by reducing only the luminance corresponding to the B component in the hue.

According to the eighth aspect of the present invention, in addition to the function according to the fifth aspect, the display image information is generated by reducing only the luminance corresponding to the B component in the hue, so that it is possible to reduce the harmful blue component while preventing the color tone of color including white color on display from being changed.

According to a ninth aspect of the present invention, the image processing apparatus according to any one of the fifth to eighth aspects is provided, wherein the color space is either one of an HLS (Hue, Luminance, Saturation) color space and an HSV (Hue, Saturation, Value) color space.

According to the ninth aspect of the present invention, in addition to the function according to any one of the fifth to eighth aspects, the color space is either one of the HLS color space and the HSV color space, so that it is possible to reduce the harmful blue component while preventing the color tone of color including white color on display from being changed.

According to a tenth aspect of the present invention, the image processing apparatus according to any one of the first to ninth aspect is provided, further comprising: a detection means such as a blue light reduction control unit that detects an average luminance in the entire image to be displayed, wherein when the detected average luminance is greater than or equal to a previously set luminance, the processing means performs the luminance control processing.

According to the tenth aspect of the present invention, in addition to the function according to any one of the first to ninth aspects, the luminance control processing is performed when the average luminance in the entire image is greater than or equal to a predetermined luminance, so that it is possible to reduce the harmful blue component without damaging color tone, feeling, or the like of the entire image.

According to an eleventh aspect of the present invention, the image processing apparatus according to any one of the first to tenth aspects is provided, wherein the processing means comprises a storage means such as a recording unit that previously stores luminance information indicating at least the reduction rate of the luminance corresponding to the B component for the luminance control processing, and a selection means such as an operation unit that is used to cause the stored luminance information to be selected, and the processing means performs the luminance control processing by using the selected luminance information.

According to the eleventh aspect of the present invention, in addition to the function according to any one of the first to tenth aspects, the luminance control processing is performed by using luminance information selected by the selection means from the luminance information stored in the storage means, so that it is possible to reduce the harmful blue component in a mode according to the intention of a user.

According to a twelfth aspect of the present invention, the image processing apparatus according to any one of the first to eleventh aspects is provided, further comprising: a region selection means such as an operation unit that is used to select a part of a display region of the display means where the image is displayed, wherein the processing means performs the luminance control processing only on the selected part.

According to the twelfth aspect of the present invention, in addition to the function according to any one of the first to eleventh aspects, the luminance control processing is performed only on a part of the display region selected by the region selection means, so that it is possible to select a part of the display region to be an object of the luminance control processing, and thereby it is possible to reduce the harmful blue component in a mode more matched to the preference of a user.

According to a thirteenth aspect of the present invention, the image processing apparatus according to any one of the first to twelfth aspects is provided, and a display means that acquires the display image information and displays an image corresponding to the display image information.

A fourteenth aspect of the present invention comprises: an acquisition step of acquiring image information corresponding to an image to be displayed on a display means such as a display; and a processing step of generating display image information by reducing at least luminance corresponding to a blue component in the acquired image information so that a reduction rate of the luminance corresponding to the blue component in the acquired image information is greater than or equal to reduction rates of luminance corresponding to the other color components in the acquired image information and outputting the display image information to the display means to cause the display means to display the display image information.

According to a fifteenth aspect, the present invention causes a computer included in an image processing apparatus to function as: an acquisition means that acquires image information corresponding to an image to be displayed on a display means such as a display; and a processing means that generates display image information by reducing at least luminance corresponding to a blue component in the acquired image, information so that a reduction rate of the luminance corresponding to the blue component in the acquired image information is greater than or equal to reduction rates of luminance corresponding to the other components in the acquired image information and outputs the display image information to the display means to cause the display means to display the display image information.

According to the first or thirteenth to fifteenth aspects, the display image information is generated and displayed by reducing at least the luminance corresponding to the blue component so that the reduction rate of luminance corresponding; to the blue component in the image information corresponding to the image to be displayed is greater than, or equal to the reduction rates of luminance corresponding to the other components. Therefore, it is possible to reduce the harmful blue component by image processing without separately using an optical member or the like that reduces the blue component.

Effect of the Invention

According to the present invention, the display image information is generated and displayed by reducing at least the luminance corresponding to the blue component so that the reduction rate of luminance corresponding to the blue component in the image information corresponding to the image to be displayed is greater than or equal to the reduction rates of luminance corresponding to the other color components in the image information.

Therefore, it is possible to reduce the harmful blue component by image processing without separately using an optical member or the like that reduces the blue component, so that it is possible to protect user's eyes by reducing the harmful blue component in a mode that matches the characteristics of an image to be displayed and the preference of the user who causes the image to be displayed.

DETAILED DESCRIPTION OF THE INVENTION

Then, embodiments of the present invention will be described below with reference to FIGS. 1 to 14. The embodiments described below are embodiments where the present invention is applied to reduction processing of blue light in a display apparatus that displays images including a moving image and a still image.

(I) First Embodiment

Figure 1:
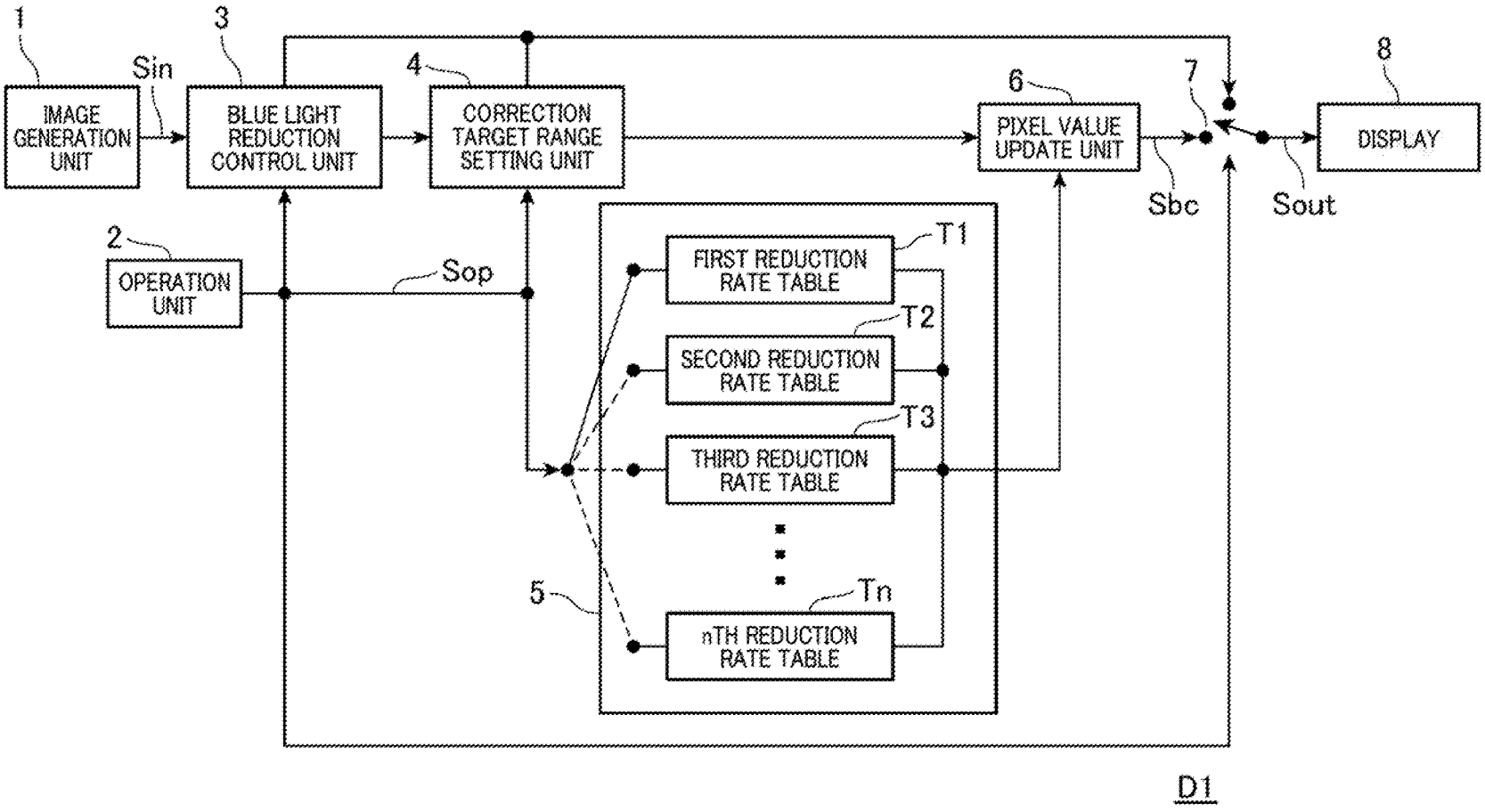
FIG. 1 is a block diagram showing a schematic configuration of a display apparatus according to a first embodiment.
Figure 3:
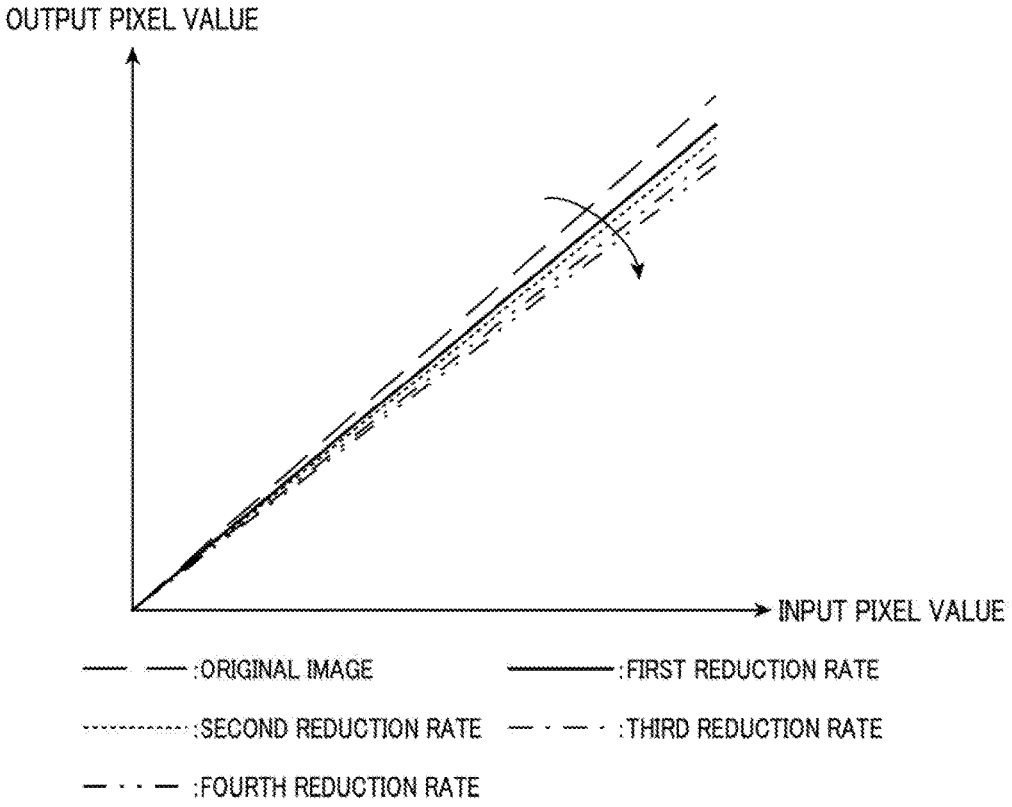
FIG. 3 is a figure illustrating differences between reduction rates according to the first embodiment.
Figure 4:
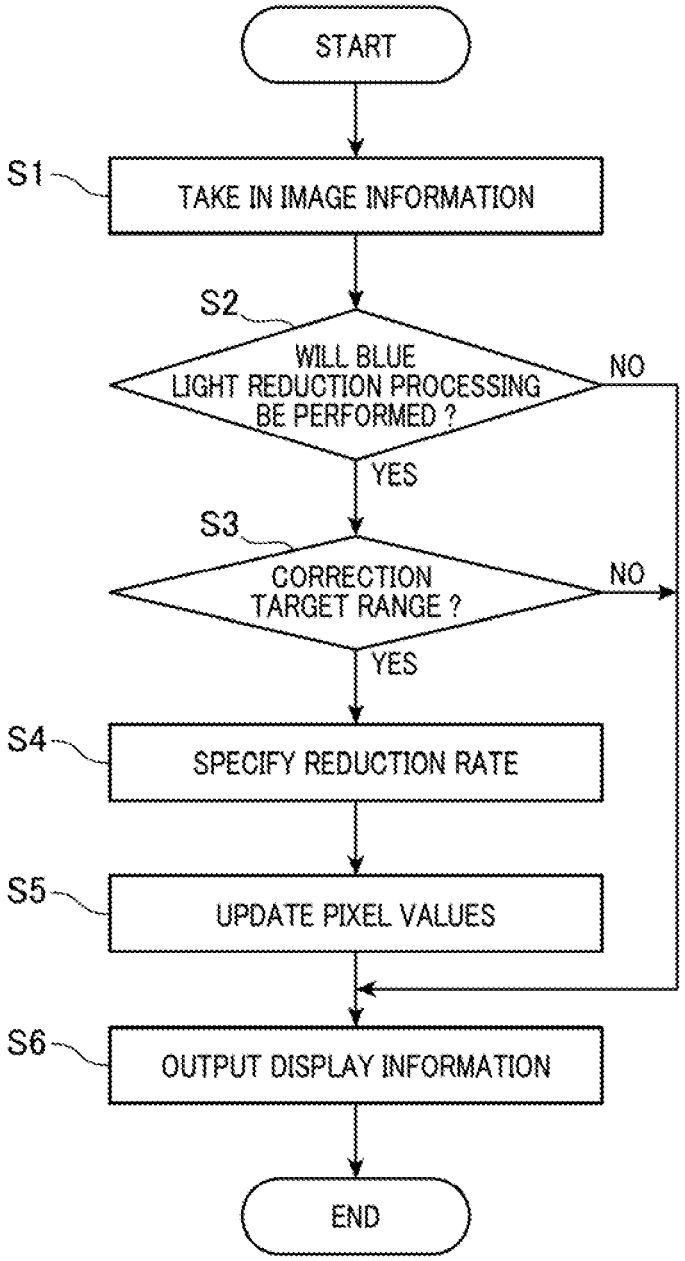
FIG. 4 is a flowchart showing the reduction processing of blue light according to the first embodiment.
Figure 5:
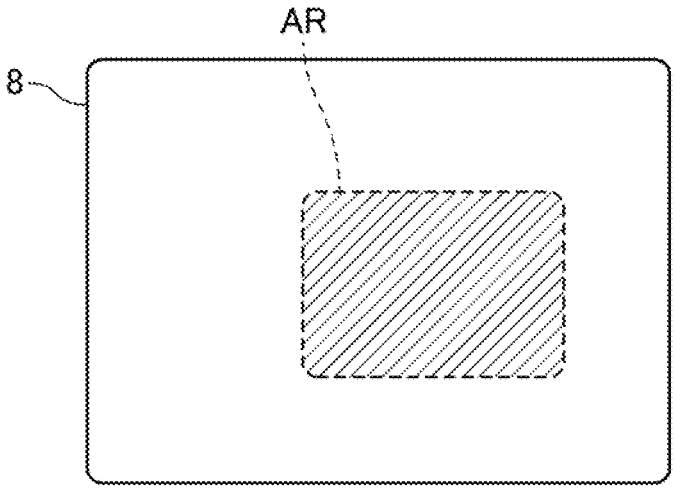
FIGS. 5(*a*) and 5(*b*) are figures illustrating a case where the reduction processing of blue light according to the first embodiment is performed for each region, FIG. 5(*a*) is a figure showing a first example, and FIG. 5(*b*) is a figure showing a second example.
Figure 5:
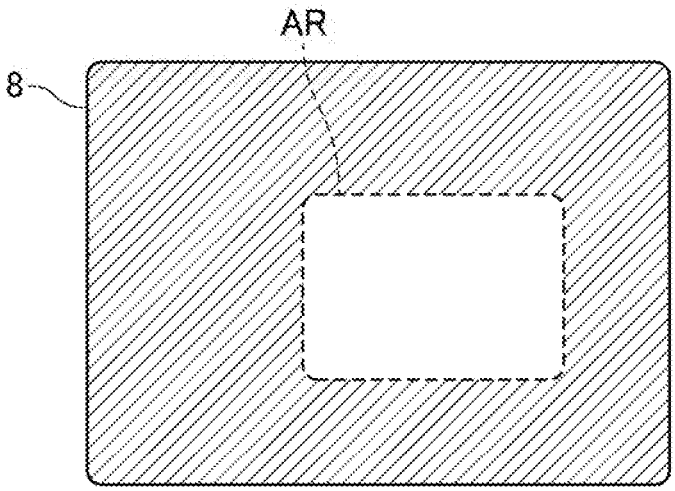
Figure 6:
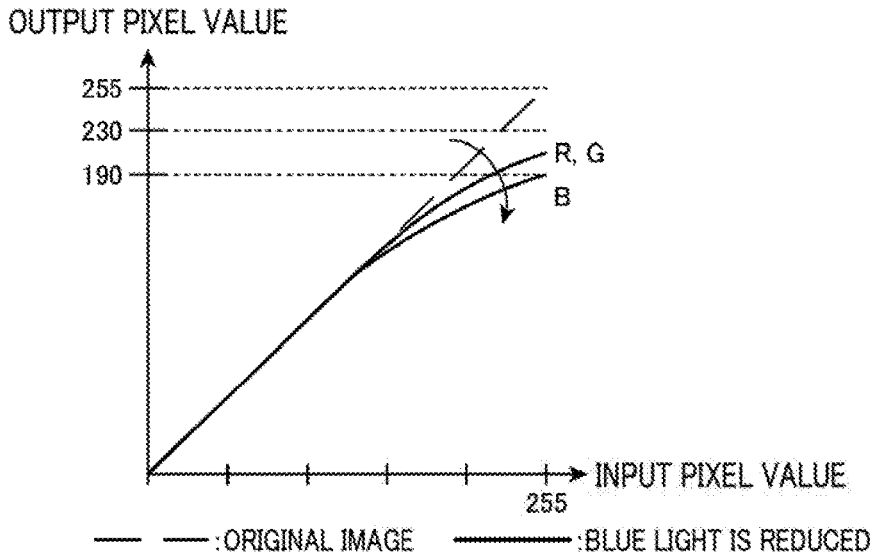
FIGS. 6(*a*) and 6(*b*) are figures showing another example of the reduction processing of blue light according to the first embodiment, FIG. 6(*a*) is a figure showing differences between luminance values of colors, and FIG. 6(*b*) is a figure explaining reduction of blue light in an RGB color space.
Figure 6:
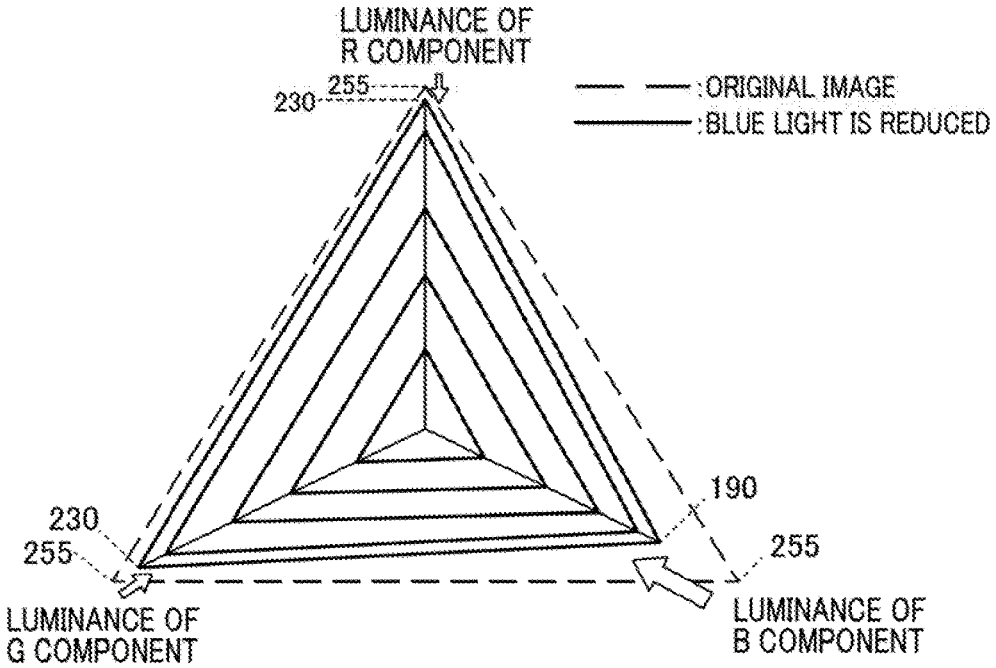
Figure 7:
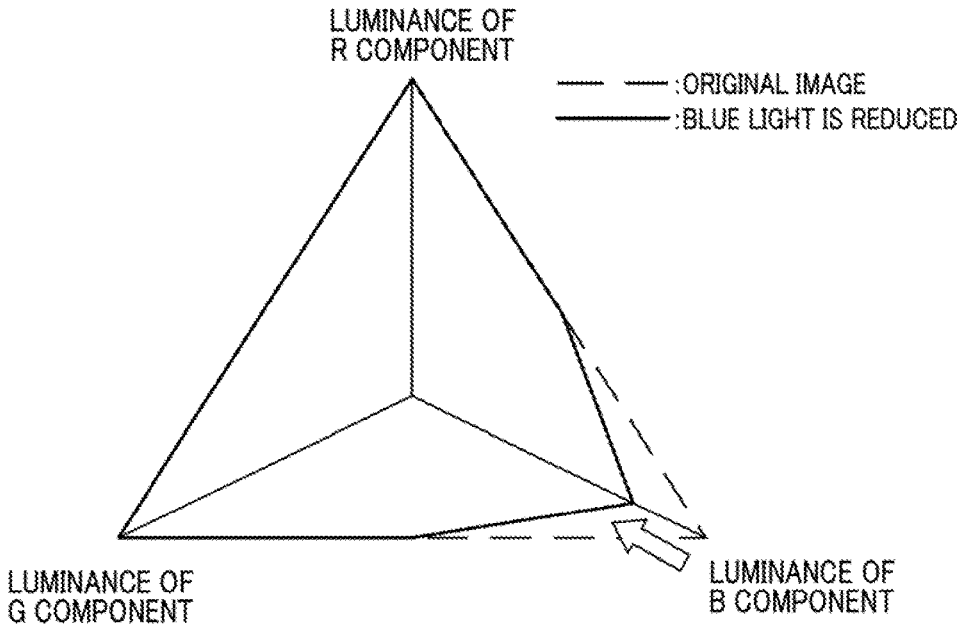
FIG. 7 is a figure showing further another example of the reduction processing of blue light according to the embodiment by using an RGB color space.

First, a first embodiment according to the present invention will be described with reference to FIGS. 1 to 7. FIG. 1 is a block diagram showing a schematic configuration of a display apparatus according to the first embodiment, FIGS. 2(*a*) and 2(*b*) are figures showing reduction processing of blue light according to the first embodiment, and FIG. 3 is a figure illustrating differences between reduction rates according to the first embodiment. Further, FIG. 4 is a flowchart showing the reduction processing, FIGS. 5(*a*) and 5(*b*) are figures illustrating a case where the reduction processing is performed for each region, and FIGS. 6(*a*) and 6(*b*) are figures showing another example of the reduction processing. Furthermore, FIG. 7 is a figure showing further another example of the reduction processing by using an RGB color space. In the description below, the reduction processing of blue light according to the first embodiment is simply referred to as "reduction processing according to the first embodiment".

As shown in FIG. 1, a display apparatus D1 according to the first embodiment comprises an image generation unit 1, an operation unit 2 which comprises a keyboard, a mouse, a touch panel, or the like and which generates an operation signal Sop that specifies processing of the display apparatus D1, a blue light reduction control unit 3, a correction target range setting unit 4, a recording unit 5 which comprises a recording medium such as a hard disk and which records a reduction rate table described later in a nonvolatile manner, a pixel value update unit 6, a switching unit 7, and a display 8 comprising a liquid crystal display, which has a backlight that is an LED, or the like.

At this time, the display 8 corresponds to an example of a "display means" according to the present invention, the blue light reduction control unit 3 corresponds to an example of an "acquisition means" and an example of a "detection means" according to the present invention, and the pixel value update unit 6 corresponds to an example of a "processing means" according to the present invention. The recording unit 5 corresponds to an example of a "storage means" according to the present invention and the operation unit 2 corresponds to an example of a "selection means" and an example of a "region selection means" according to the present invention.

In this configuration, the image generation unit 1 generates image information Sin corresponding to an image (which includes at least either one of a still image and a moving image, and so forth) to be displayed on the display 8 and outputs the image information Sin to the blue light reduction control unit 3. On the other hand, the recording unit 5 records, in a nonvolatile manner, n (n is an integer) reduction rate tables which are reduction rate tables that are set in advance for the reduction processing according to the first embodiment and which include at least a reduction rate parameter used when reducing a B component in the image described above. Each reduction rate table will be described later in detail.

On the other hand, based on an operation of a user, the operation unit 2 generates the operation signal Sop respectively including an ON/OFF signal indicating whether or not to perform the reduction processing according to the first embodiment, a range specification signal indicating a range in an image to be an object of the reduction processing in a case of performing the reduction processing, and a table specification signal for specifying the reduction rate table used for the reduction processing in a case of performing the reduction processing. Then, the operation unit 2 outputs the ON/OFF signal to the blue light reduction control unit 3 and the switching unit 7, outputs the range specification signal to the correction target range setting unit 4 and the switching unit 7, and outputs the table specification signal to the recording unit 5. At this time, if the image to be displayed on the display 8 is, for example, an image corresponding to an movie, it is preferable that an operation not to perform the reduction processing according to the first embodiment is performed on the operation unit 2 in order to maintain the quality of the image. On the other hand, if the image to be displayed on the display 8 is, for example, an image corresponding to a business document, it is preferable that an operation to perform the reduction processing according to the first embodiment is performed on the operation unit 2 in order to effectively reduce the blue light. In a case of performing the reduction processing according to the first embodiment, the table specification signal, on which an operation to select a reduction rate of the reduction processing is reflected, is generated and output.

Thereby, the blue light reduction control unit 3 determines whether or not to perform the reduction processing according to the first embodiment on the image information Sin based on the ON/OFF signal, and outputs the image information Sin to the correction target range setting unit 4 in a case of performing the reduction processing. On the other hand, in a case of not performing the reduction processing, the blue light reduction control unit 3 directly outputs the image information Sin to the switching unit 7.

Subsequently, the correction target range setting unit 4 outputs the image information Sin for pixels of the image information Sin to be an object of the reduction processing according to the first embodiment to the pixel value update unit 6 based on the range specification signal from the operation unit 2. On the other hand, the correction target range setting unit 4 directly outputs the image information Sin for pixels of the image information Sin other than the pixels of the image information Sin to be an object of the reduction processing to the switching unit 7.

On the other hand, the recording unit 5 outputs the reduction rate parameter included in the reduction rate table specified by the table specification signal from the operation unit 2 to the pixel value update unit 6.

Thereby, the pixel value update unit 6 updates pixel values (more specifically, for example, luminance values) of B component, R component, and G component of each pixel included in the image information Sin output from the correction target range setting unit 4 to pixel values indicated by the reduction rate table output from the recording unit 5 and outputs the updated pixel values to the switching unit 7 as update image information Sbc. Here, the upper limit value of the pixel value (or the luminance value) is determined by the number of gradations. In a case where the display 8 is configured by a liquid crystal display, if the display 8 is a 24-bit RGB liquid crystal display, the upper limit value is "255 ($2^8-1$)" for each color component of the three colors, and if the display 8 is a 18-bit RGB liquid crystal display, the upper limit value is "63 ($2^8-1$)" for each color component of the three colors.

Then, the switching unit 7 switches the image information Sin of pixels not to be an object of the reduction processing according to the first embodiment to the blue light reduction control unit 3 or the correction target range setting unit 4 and directly outputs the image information Sin to the display 8 as display information Sout based on the ON/OFF signal and the range specification signal from the operation unit 2. On the other hand, the switching unit 7 switches the image information Sin of pixels to be an object of the reduction processing according to the first embodiment to the pixel value update unit 6 and outputs the update image information Sbc to the display 8 as the display information Sout.

Finally, the display 8 displays an image corresponding to the display information Sout output from the switching unit 7.

Next, the reduction rate table used for the reduction processing according to the first embodiment will be described with reference to FIGS. 2(*a*) and 2(*b*).

In the reduction processing according to the first embodiment, the blue light in an image corresponding to the image information Sin is reduced by color adjustment processing as the display apparatus D1 without separately using a special optical component described as the background art. The "reduction rate" in the description below is a parameter defined by the following expression assuming that each pixel value of an input image (image information Sin) in a case where the reduction processing according to the first embodiment is not performed is "1".

$$\text{Reduction rate [\%]}=(1-(\text{output pixel value}/\text{input pixel value}))\times 100$$

At this time, the brightness of the backlight and the luminance of a displayed image may not be in a proportional relationship, so that it should be noted that the reduction rate as image information is different from the reduction rate of energy generated from the display 8 when an image is actually displayed on the display 8.

Figure 2:
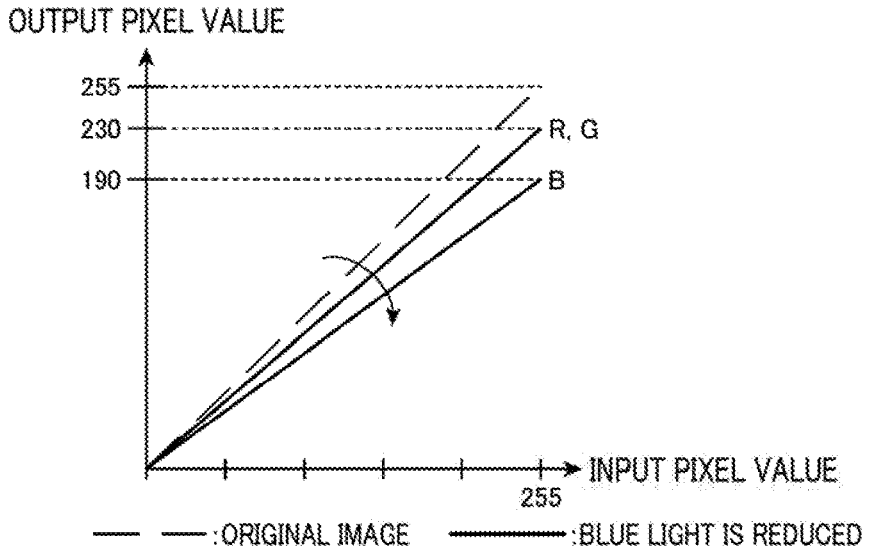
FIGS. 2(*a*) and 2(*b*) are figures showing reduction processing of blue light according to the first embodiment, FIG. 2(*a*) is a figure showing differences between luminance values of colors, and FIG. 2(*b*) is a figure explaining reduction of blue light in an RGB color space.
Figure 2:
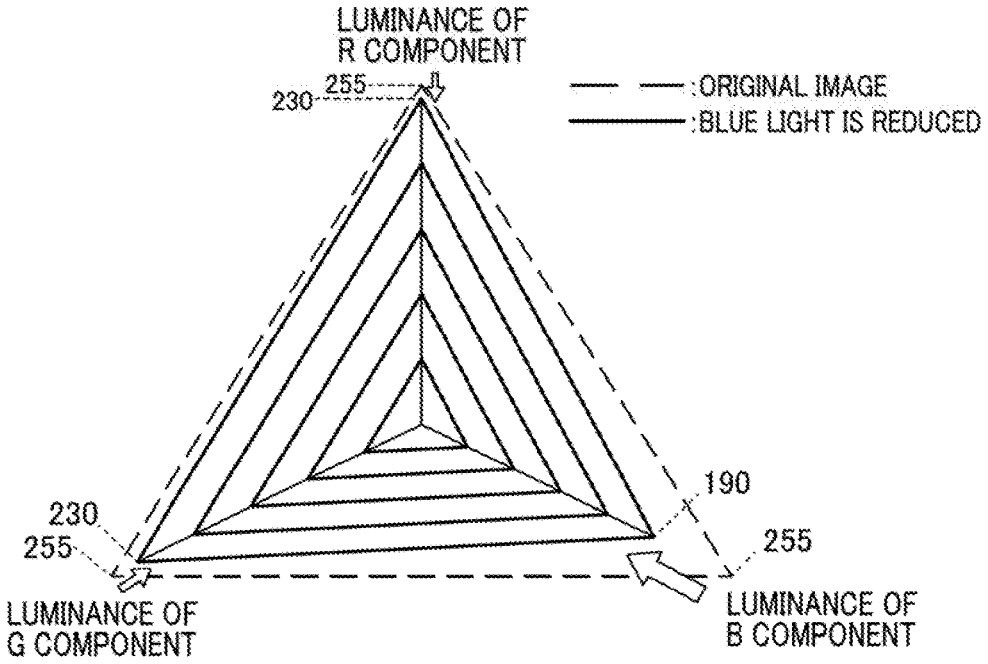

Specifically, as illustrated in FIG. 2(*a*), in a case where the horizontal axis represents an input pixel value and the vertical axis represents an output pixel value, in the reduction processing according to the first embodiment, for an original image indicated by a dashed line in FIG. 2(*a*) (that is, an image corresponding to the image information Sin), the luminance of each color component is updated by the pixel value update unit 6 so that the reduction rate of B component is greater than the reduction rates of the other color components (R component and G component) and the updated image is output to the switching unit 7 as the update image information Sbc. For example, the reduction processing is performed for each pixel. Here, the wavelength of the B component is, for example, about 440 nm to 490 nm, the wavelength of the R component is, for example, about 620 nm to 740 nm, and the wavelength of the G component is, for example, about 500 nm to 600 nm. Further, in FIG. 2(*a*), when the graphs of the R component and the G component are represented by, for example, output pixel value=input pixel value×0.9, the reduction rates of the R component and the G component are 10% ((1−0.9)×100), and when the graph of the B component is represented by, for example, output pixel value=input pixel value×0.75, the reduction rate of the B component is 25% ((1−0.75)×100). On the other hand, when the reduction processing illustrated in FIG. 2(*a*) is represented in an RGB color space, for example, the result is as illustrated in FIG. 2(*b*). As it is clear from FIG. 2(*b*), in the reduction processing according to the first embodiment, not only the B component, but also the R component and the G component are reduced. However, regarding the reduction rates of these components, the reduction rate of the B component is greater than the reduction rates of the other color components.

In FIG. 2(*a*), it is possible to reduce only the B component. However, in this case, a color tone of the entire image changes (more specifically, the color becomes yellowish), so that it is not preferable for the display apparatus D1. Therefore, in the reduction processing according to the first embodiment, as illustrated in FIG. 2(*a*), not only the B component, but also the components R and G are reduced. At this time, for example, the reduction rates of the components R and G are set to be greater than or equal to a quarter of the reduction rate of the B component and smaller than or equal to a half of the reduction rate of the B component. More specifically, for example, in a case where the reduction rate of the B component is 10%, the reduction rates of the components R and G are set to be greater than or equal to 2.5% and smaller than or equal to 5%. Thereby, it is possible to reduce the harmful blue light while suppressing the change of color tone of the entire image. However, at this time, depending on the content of the image, there may be a case in which only the B component may be reduced (in other words, a case in which the reduction rates of the components R and G are set to zero (the components R and G are not reduced)). Also in this case, in the display apparatus D1 according the first embodiment, the above operation can be performed by selecting a reduction rate table for reducing only the B component.

In the recording unit 5 of the display apparatus D1 according to the first embodiment, for example, as illustrated in FIG. 1, the reduction rate tables, which include reduction rate parameters indicating purpose of the reduction processing according to the first embodiment illustrated in FIGS. 2A and 2B for different reduction rates, respectively, are recorded in advance as a first reduction rate table T1, a second reduction rate table T2, a third reduction rate table T3, . . . , and an nth reduction rate table Tn. At this time, regarding differences of the reduction rates between the reduction rate tables, for example, as illustrated in FIG. 3, the reduction rates according to the purpose illustrated in FIGS. 2A and 2B are recorded in advance for each color component so that the greater the serial number of the reduction rate table is, the greater the reduction rate is. It is considered that the actual values of the reduction rate parameters in each reduction rate table are determined in advance by, for example, experiment or experience.

Next, the reduction processing according to the first embodiment will be described more specifically with reference to FIGS. 4, 5A, and 5B.

As shown in FIG. 4, in the reduction processing according to the first embodiment, when the image information Sin is input from the image generation unit 1, first, the image information Sin is taken into the blue light reduction control unit 3 (step S1). Then, the blue light reduction control unit 3 determines whether or not to perform the reduction processing according to the first embodiment on the image information Sin based on the ON/OFF signal from the operation unit 2 (step S2). In a case where the blue light reduction control unit 3 determines to perform the reduction processing in step S2 (step S2; YES), the blue light reduction control unit 3 outputs the image information Sin to the correction target range setting unit 4. On the other hand, in a case where the blue light reduction control unit 3 determines not to perform the reduction processing in step S2 (step S2; NO), the blue light reduction control unit 3 directly outputs the image information Sin to the switching unit 7 (step S6).

Subsequently, the correction target range setting unit 4 discriminates between pixels to be an object of the reduction processing according to the first embodiment in the image information Sin and pixels other than the pixels to be the object of the reduction processing in the image information Sin based on the range specification signal from the operation unit 2 (step S3). More specifically, for example, in a case where the range specification signal indicates that pixels included in a range AR illustrated in FIG. 5(*a*) are objects of the reduction processing according to the first embodiment (step S3; YES), the correction target range setting unit 4 outputs the image information Sin of the pixels in the range AR to the pixel value update unit 6. On the other hand (step S3; NO), the correction target range setting unit 4 outputs the image information Sin of pixels other than the pixels in the range AR to the switching unit 7 directly (step S6). In this case, as illustrated in FIG. 5(*b*), it is possible to configure so that a range AR including an image that is not an object of the reduction processing according to the first embodiment is specified by the range specification signal from the operation unit 2 and pixels included in a range other than the range AR are set to be objects of the reduction processing according to the first embodiment.

In parallel with these, in the recording unit 5, selection of the reduction rate table indicated by the table specification signal from the operation unit 2 (in other words, specification of the reduction rate) is performed (step S4) and a reduction rate parameter included in the reduction rate table specified by the table specification signal is output to the pixel value update unit 6.

Thereby, the pixel value update unit 6 updates pixel values of the B component, the R component, and the G component of each pixel included in the image information Sin output from the correction target range setting unit 4 to pixel values indicated by the reduction rate table output from the recording unit 5 (step S5) and outputs the updated pixel values to the switching unit 7 as the update image information Sbc.

Then, the switching unit 7 switches between the blue light reduction control unit 3 or the correction target range setting unit 4 and the pixel value update unit 6 based on the ON/OFF signal and the range specification signal from the operation unit 2 and outputs the display information Sout to the display 8 to cause the display 8 to display the display information Sout (step S6).

As described above, according to the reduction processing according to the first embodiment, the display information Sout is generated and displayed by reducing at least the luminance corresponding to the B component so that, for example, the reduction rate of the luminance corresponding to the B component in the image information Sin corresponding to an image to be displayed is greater than, for example, the reduction rate of the luminance corresponding to each of the components R and G in the image information. Therefore, it is possible to reduce the harmful blue light by image processing without separately using an optical member or the like that reduces the B component.

Further, the reduction rate corresponding to each of the R component and the G component is set to be greater than or equal to a quarter of the reduction rate corresponding to the B component and smaller than or equal to a half of the reduction rate corresponding to the B component, so that it is possible to reduce the harmful blue light while preventing the change of color tone of the entire image by reducing the R component and the G component while considering the balance with the B component.

Further, the reduction processing is performed by using a reduction rate table selected by an operation of the operation unit 2 from among the reduction rate tables recorded in the recording unit 5, so that it is possible to reduce the harmful blue light in a mode according to the intention of a user.

Furthermore, in a case where the reduction processing according to the first embodiment is performed only on a range selected by the operation unit 2, the range on which the reduction processing is performed can be selected, so that it is possible to reduce the harmful blue light in a mode more matched to the preference of a user. In this case, in addition to a case in which a user specifies a range to be an object of the reduction processing according to the first embodiment as illustrated in FIGS. 5(*a*) and 5(*b*), it is possible to configure so that the user specifies a so-called window in which an image to be an object of the reduction processing according to the first embodiment (for example, an image of a document) or an image not to be an object of the reduction processing (for example, an image of a movie) is displayed. In this case, when the window is moved, the position of pixels to be an object (or not to be an object) of the reduction processing in the display 8 is changed. However, it is possible to control so that the image displayed in the window is always an object of (or not an object of) the reduction processing.

Regarding the reduction processing according to the first embodiment, it is possible to use a mode other than the mode described above.

For example, in the first embodiment described above, a case is described in which the reduction rate of each color component is linearly changed as illustrated using FIG. 2(*a*), 2(*b*), or 3. However, in addition to the above, for example, as illustrated in FIG. 6(*a*), it is possible to configure so that the greater the luminance in the input image information Sin is, the greater the reduction rate is. In this case, when the reduction processing illustrated in FIG. 6(*a*) is represented in an RGB color space, for example, as illustrated in FIG. 6(*b*), the reduction rates change unevenly. Such reduction processing can be realized by changing the content of reduction rate parameters included in the reduction rate tables according to the first embodiment.

Further, as illustrated in FIG. 7, instead of setting R, G, and B independently from each other, for example, even in a case where an image to be an object of the reduction processing according to the first embodiment includes a large amount of B component, if the amounts of R component and G component are large in the same manner, the reduction rate of B component may be decreased, and if the amounts of R component and G component are small (in other words, the image is an image (pixels) closer to pure "blue"), the reduction rate of blue color may be increased. In this case, the greater the amount of B component in a pixel comprised in an image as compared with the amount of R component and the amount of G component, the higher the reduction rate corresponding to the B component in a case where the display information Sout is generated. Therefore, the greater the amount of B component in a pixel, the greater the amount of B component to be reduced, so that it is possible to reduce the harmful B component, while preventing the change of color tone of the entire image by reducing the B component considering the balance between the color components.

For example, as another mode obtained by applying the mode explained by using FIG. 7, the RGB color space is converted into a color space such as an HLS (Hue Luminance Saturation) space or an HSV (Hue Value Saturation) color space, the blue light is efficiently reduced by controlling the reduction rates for each color space while considering not only the three primary colors R, G, and B, but also cyan, magenta, yellow, and the like, and the color space is reconverted into the RGB color space, then an image in the RGB color space may be displayed by the display 8. Therefore, an embodiment in which the present invention is implemented by using the HLS color space or the HSV color space will be described below as a second embodiment of the present invention.

(II) Second Embodiment

Figure 11:
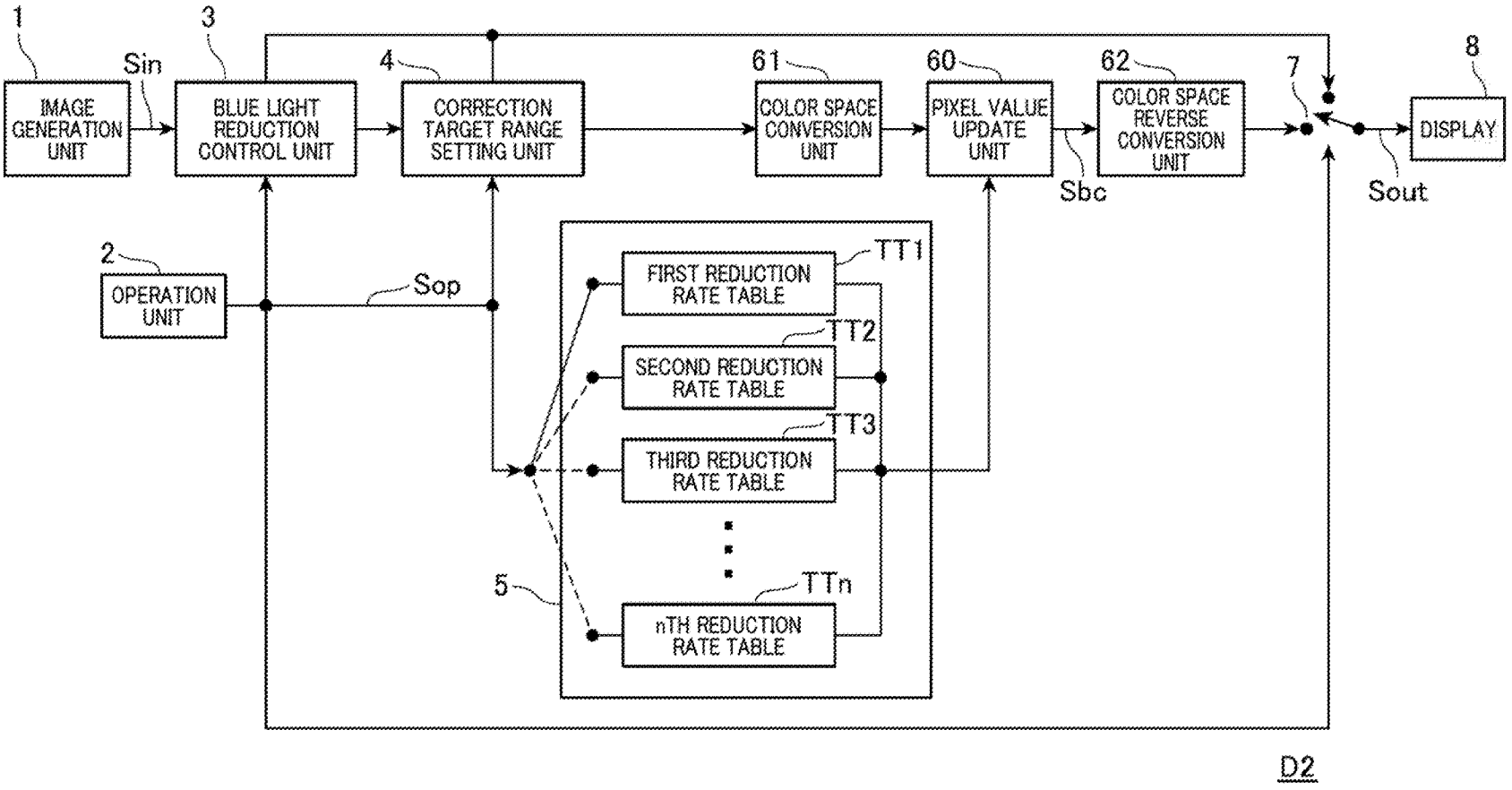
FIG. 11 is a block diagram showing a schematic configuration of a display apparatus according to the second embodiment.
Figure 12:
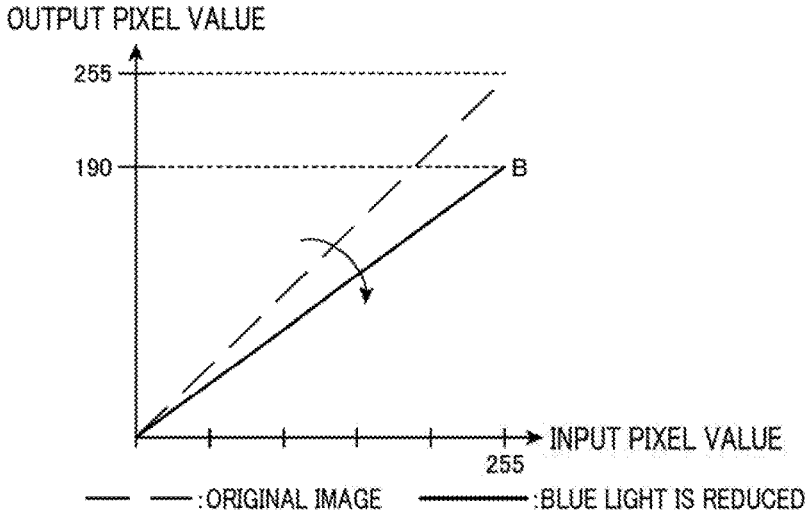
FIGS. 12(*a*) and 12(*b*) are figures showing reduction processing of blue light according to the second embodiment, FIG. 12(*a*) is a figure showing differences between luminance values of colors, and FIG. 12(*b*) is a figure explaining reduction of blue light in hue of the HLS color space.
Figure 12:
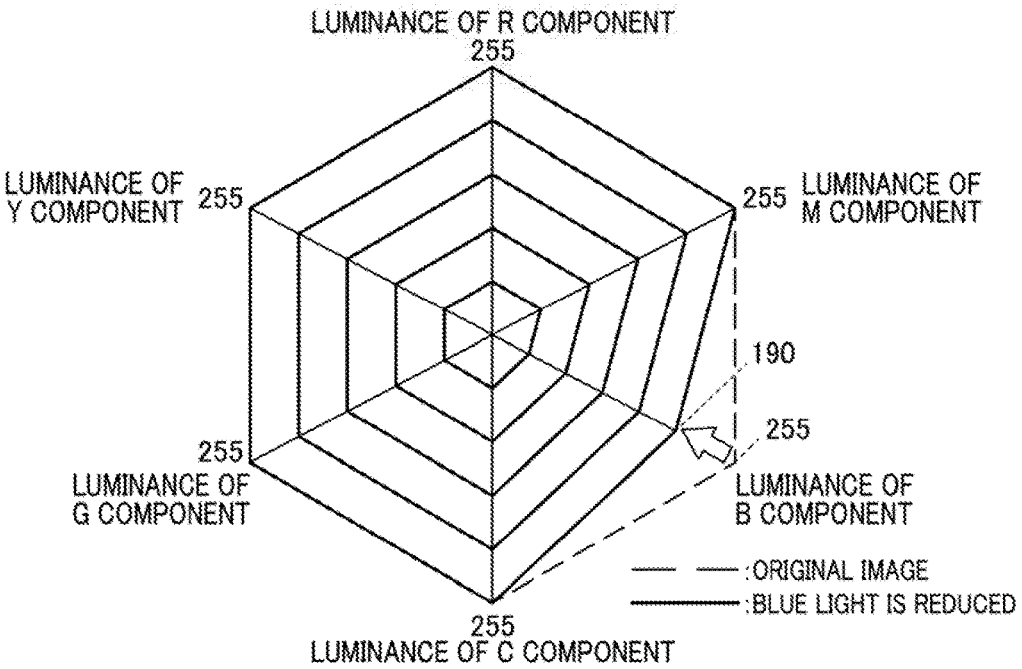
Figure 13:
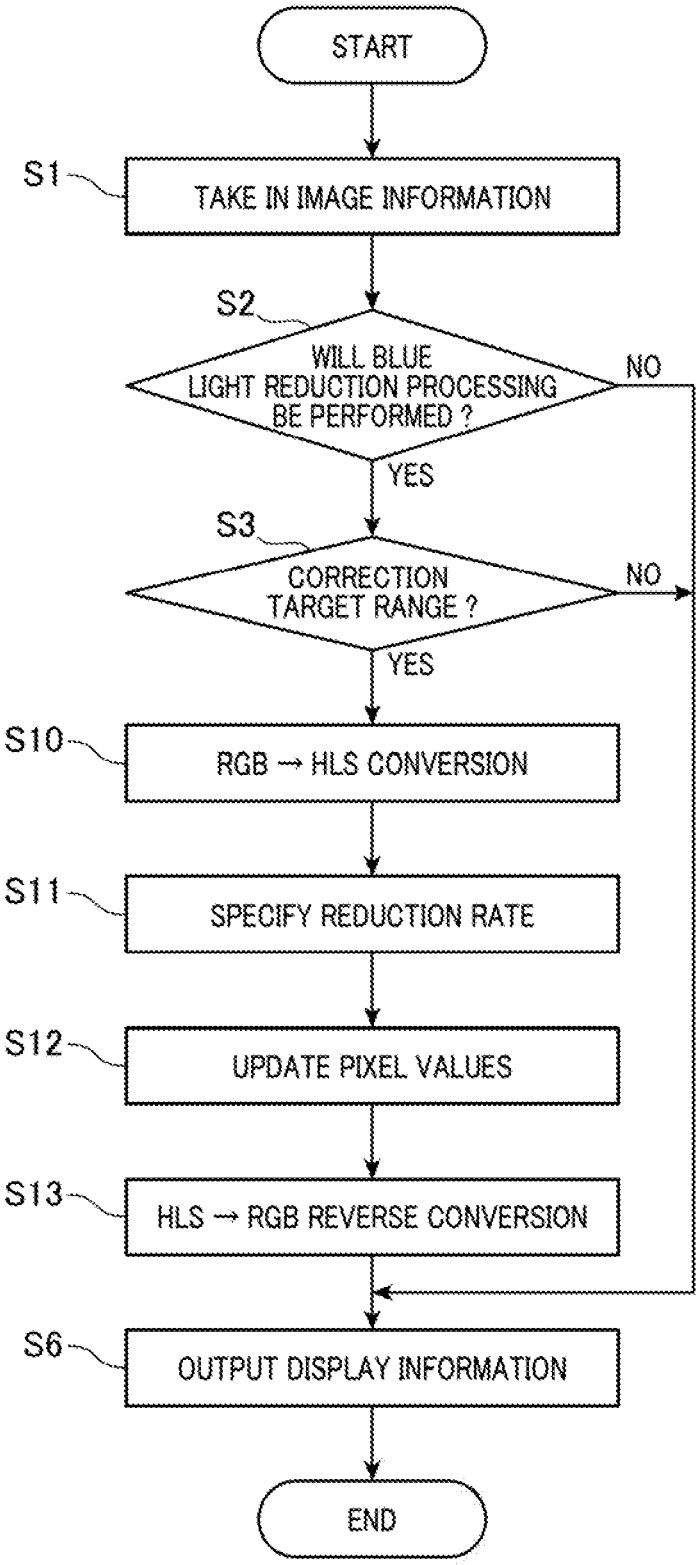
FIG. 13 is a flowchart showing the reduction processing of blue light according to the second embodiment.

Next, a second embodiment will be described with reference to FIGS. 8*a* to 14*b*. FIGS. 8*a* to 10*b* are figures explaining a principle and the like of the second embodiment, FIG. 11 is a block diagram showing a schematic configuration of a display apparatus according to the second embodiment, and FIGS. 12*a* and 12*b* are figures showing reduction processing of blue light according to the second embodiment. Further, FIG. 13 is a flowchart showing the reduction processing and FIGS. 14(*a*) and 14(*b*) are figures showing another example of the reduction processing. In the description below, the reduction processing of blue light according to the second embodiment is simply referred to as "reduction processing according to the second embodiment".

(A) About HLS Color Space and HSV Color Space

First, an HLS color space and an HSV color space according to the second embodiment will be described with reference to FIGS. 8*a* and 8*b*. The HLS color space and the HSV color space are color spaces that have been generally known along with the RGB color space according to the first embodiment for image processing.

Figure 8:
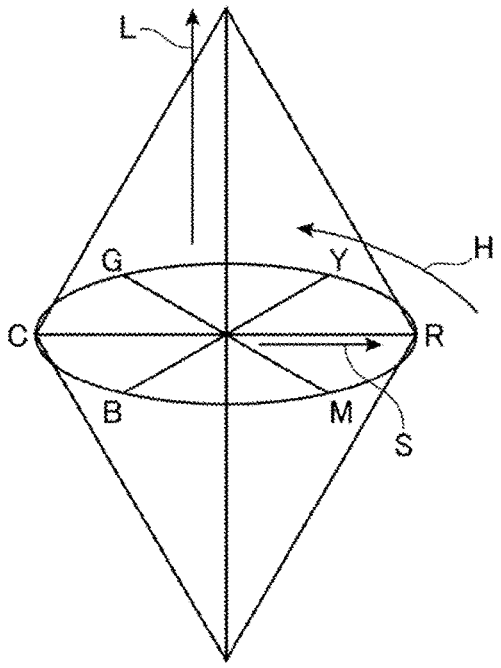
FIGS. 8(*a*) and 8(*b*) are figures (I) explaining a principle of a second embodiment, FIG. 8(*a*) is a figure showing a concept of an HLS color space, and FIG. 8(*b*) is a figure showing a concept of an HSV color space.
Figure 8:
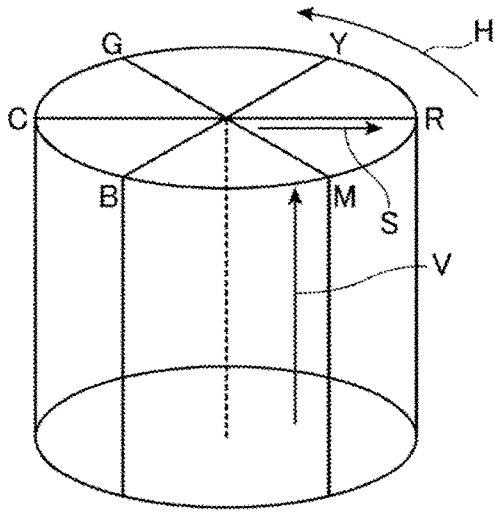

First, FIG. 8(*a*) shows a concept of the HLS color space used for the reduction processing according to the second embodiment in a vertically symmetric two-cone shape. The HLS color space comprises a hue axis H, a luminance axis L, and a saturation axis S.

Among them, the hue axis H is an axis that represents a so-called "color tone" in a range from 0 degrees to 360 degrees. As illustrated in FIG. 8(*a*), the hue axis H includes a C (Cyan) component, an M (Magenta) component, and a Y (Yellow) component in addition to an R (Red) component, a G (Green) component, and a B (Blue) component. At this time, for example, 0 degrees is the R component, and 180 degrees that is located on the opposite side of the 0 degrees on the hue axis H is a blue-green component corresponding to an opposite color of the R component. When the HLS color space is used, it is easy to obtain an opposite color. The wavelength of the B component is, for example, about 440 nm to 490 nm, the wavelength of the R component is, for example, about 620 nm to 740 nm, and the wavelength of the G component is, for example, about 500 nm to 600 nm. The C component is a component comprising the G component and the B component, the M component is a component comprising the R component and the B component, and the Y component is a component comprising the R component and the G component.

Next, the saturation axis S is an axis that represents "vividness of color" in a range from 0% (central axis itself) to 100% (outermost circumference) likening to a distance from the luminance axis L (the central axis of the HLS color space). The saturation axis S is a concept based on an idea that falling of saturation from a pure color means approaching gray.

Finally, the luminance axis L is an axis that represents "brightness of color" in a range from 0% to 100%. The luminance 0% (the lowermost end in FIG. 8(*a*)) represents "black", the luminance 100% (the uppermost end in FIG. 8(*a*)) represents "white", and a middle between them is 50% (a position of a disk representing the hue axis H) which represents a pure color.

Next, FIG. 8(*b*) shows a concept of the HSV color space used for the reduction processing according to the second embodiment in a cylindrical shape. The HSV color space comprises a hue axis H, a value (or a luminance) axis V, and a saturation axis S.

Among them, the hue axis H is basically the same axis as the hue axis H in the HLS color space. The hue axis H represents kinds of colors by angles from 0 degrees to 360 degrees and includes a C component, an M component, and a Y component in addition to an R component, a G component, and a B component.

Next, the saturation axis S is an axis that represents "vividness of color" in a range from 0% (central axis itself) to 100% (outermost circumference) likening to a distance from the value axis V (the central axis of the HSV color space) in the same manner as the saturation axis S in the HLS color space.

Finally, the value axis V is an axis that represents "brightness of color" in a range from 0% to 100% in a similar manner to the luminance axis L in the HLS color space. At this time, the value axis V represents how much brightness is lost from a pure color of value 100%. The value axis V is different from the luminance axis L in the HLS color space, in which "black" is luminance 0%, "white" is luminance 100%, and an intermediate luminance 50% is a pure color. In this regard, it can be said that 50% or less in the luminance axis L in the HLS color space corresponds to the value axis V in the HSV color space, and 50% or more in the luminance axis L in the HLS color space corresponds to the saturation axis S the HSV color space.

(B) About Principle of Second Embodiment

Next, a principle of the reduction processing according to the second embodiment, which is applied to the HLS color space or the HSV color space, will be described with reference to FIGS. 9(*a*), 9(*b*), 10(*a*), and 10(*b*) for each color space.

Figure 9:
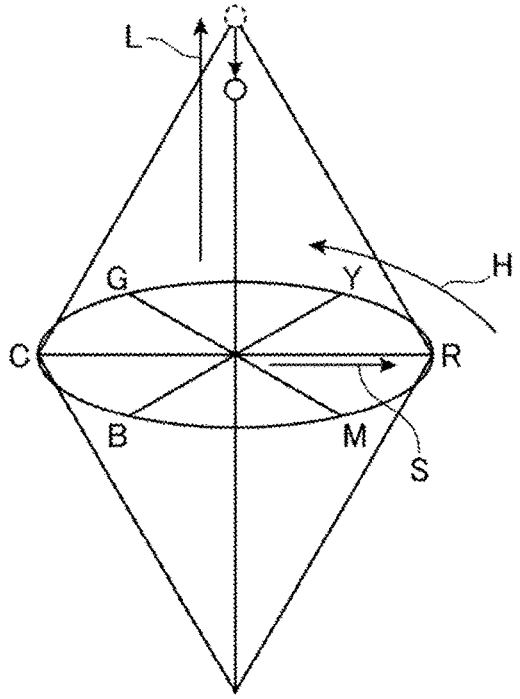
FIGS. 9(*a*) and 9(*b*) are figures (II) explaining the principle of the second embodiment, FIG. 9(*a*) is a figure explaining reduction processing of blue light (I) in the HLS color space, and FIG. 9(*b*) is a figure explaining reduction processing of blue light (II) in the HLS color space.
Figure 9:
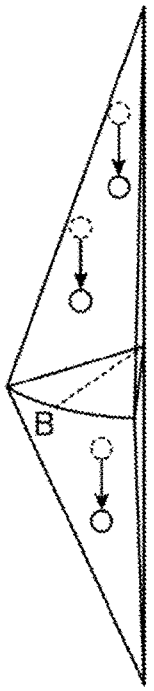

First, in a case of performing the reduction processing according to the second embodiment on a white color (achromatic color) in the HLS color space, as illustrated by a dashed line circle and a solid line circle in FIG. 9(*a*), by reducing the luminance, for example, from a level of the dashed line circle to a level of the solid line circle on the luminance axis L, it is possible to reduce the blue light without changing a color tone on a display displayed by the display 8. On the other hand, in a case of performing the reduction processing according to the second embodiment on the B component in the HLS color space, as illustrated by dashed line circles and solid line circles in FIG. 9(*b*), by reducing levels of only B components in the hue axis H, it is possible to reduce the blue light, while suppressing change of color tone on an overall display by reducing the influence on the other color components (for example, C component and M component).

Figure 10:
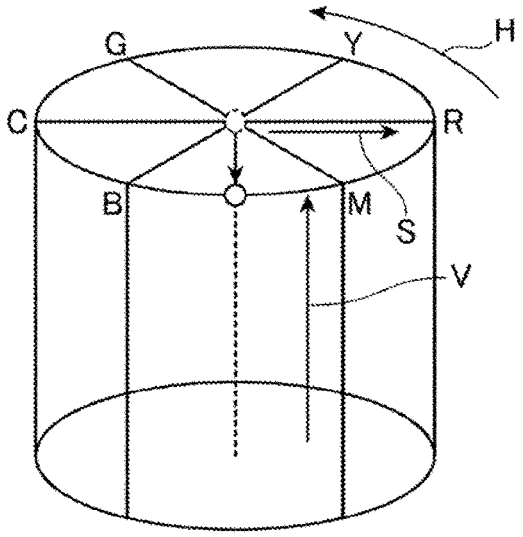
FIGS. 10(*a*) and 10(*b*) are figures (III) explaining the principle of the second embodiment, FIG. 10(*a*) is a figure explaining reduction processing of blue light (I) in the HSV color space, and FIG. 10(*b*) is a figure explaining reduction processing of blue light (II) in the HSV color space.
Figure 10:
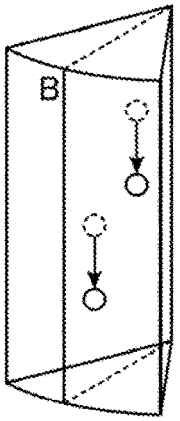

On the other hand, in a case of performing the reduction processing according to the second embodiment on a white color (achromatic color) in the HSV color space, as illustrated by a dashed line circle and a solid line circle in FIG. 10(*a*), by reducing the luminance, for example, from a level of the dashed line circle to a level of the solid line circle on the luminance axis L in the same manner as in the case of the HLS color space, it is possible to reduce the blue light without changing a color tone on a display displayed by the display 8. Further, in a case of performing the reduction processing according to the second embodiment on the B component in the HSV color space, as illustrated by dashed line circles and solid line circles in FIG. 10(*b*), by reducing levels of only B components in the hue axis H in the same manner as in the case of the HLS color space, it is possible to reduce the blue light while suppressing change of color tone on an overall display by reducing the influence on the other color components.

(C) Configuration, Operation, and the Like of Display Apparatus according to Second Embodiment Next, a configuration, an operation, and the like of the display apparatus according to the second embodiment, which performs the reduction processing according to the second embodiment using the principle described above, will be described specifically with reference to FIGS. 11 to 14(*b*). In FIGS. 11 to 14(*b*), the same member and the same step as those of the display apparatus D1 according to the first embodiment are given the same member number and the same step number and detailed description will be omitted. In the description below, as an example of the reduction processing according to the second embodiment, a case in which the HLS color space is used will be described.

As shown in FIG. 11, a display apparatus D2 according to the second embodiment comprises a pixel value update unit 60 according to the second embodiment, a color space conversion unit 61 according to the second embodiment, a color space reverse conversion unit 62 according to the second embodiment in addition to the image generation unit 1, the operation unit 2, the blue light reduction control unit 3, the correction target range setting unit 4, the recording unit 5, the switching unit 7, and the display 8, which have the same configuration and function as those of the display apparatus D1 according to the first embodiment. The recording unit 5 is different from the recording unit 5 of the display apparatus D1 according to the first embodiment in a point that the reduction rate tables recorded in the recording unit 5 is reduction rate tables which are set in advance for the reduction processing according to the second embodiment and which include at least a reduction rate parameter used when reducing the B component in the image. Each reduction rate table according to the second embodiment will be described later in detail.

The image information Sin output from the image generation unit 1 in the display apparatus D2 according to the second embodiment which has the configuration described above includes color data and the like corresponding to the RGB color space in the same manner as in the case of the display apparatus D1 according to the first embodiment. The correction target range setting unit 4 outputs the image information Sin for pixels of the image information Sin to be an object of the reduction processing according to the second embodiment to the color space conversion unit 61 based on the range specification signal from the operation unit 2. On the other hand, the correction target range setting unit 4 directly outputs the image information Sin for pixels of the image information Sin other than the pixels of the image information Sin to be an object of the reduction processing to the switching unit 7.

Then, the color space conversion unit 61 converts the color space, to which the image information Sin output from the correction target range setting unit 4 corresponds, from the RGB color space to the HLS color space and outputs the image information Sin corresponding to the HLS color space after the conversion to the pixel value update unit 60. Further, the conversion processing itself of the color space in the color space conversion unit 60 (the conversion processing from the RGB color space to the HLS color space) is the same as conventional conversion processing, so that detailed description will be omitted.

On the other hand, a reduction rate parameter included in a reduction rate table specified by the table specification signal from the operation unit 2 is output from the recording unit 5 to the pixel value update unit 60.

Thereby, the pixel value update unit 60 updates a pixel value (more specifically, for example, luminance) of at least B component in the HLS color space in each pixel included in the image information Sin output from the color space conversion unit 61 to a pixel value indicated by the reduction rate table output from the recording unit 5 and outputs the updated pixel value to the color space reverse conversion unit 62 as update image information Sbc. The update of pixel value in this case is an update of pixel value based on the principle illustrated in FIGS. 9(*a*) and 9(*b*).

Then, the color space reverse conversion unit 62 reversely converts the color space, to which the update image information Sbc output from the pixel value update unit 60 corresponds, from, the HLS color space to the RGB color space and outputs the update image information Sbc corresponding to the RGB color space after the reverse conversion to the switching unit 7. Further, the reverse conversion processing itself of the color space in the color space reverse conversion unit 62 (the reverse conversion processing from the HLS color space to the RGB color space) is the same as conventional reverse conversion processing, so that detailed description will be omitted.

Then, the switching unit 7 switches the image information Sin of pixels not to be an object of the reduction processing according to the second embodiment to the blue light reduction control unit 3 or the correction target range setting unit 4 and directly outputs the image information Sin to the display 8 as display information Sout based on the ON/OFF signal and the range specification signal from the operation unit 2. On the other hand, the switching unit 7 switches the image information Sin of pixels to be an object of the reduction processing according to the second embodiment to the color space reverse conversion unit 62 and outputs the update image information Sbc according to the second embodiment to the display 8 as the display information Sout.

Finally, the display 8 displays an image corresponding to the display information Sout output from the switching unit 7.

Next, the reduction rate table used for the reduction processing according to the second embodiment will be described with reference to FIGS. 12(*a*) and 12(*b*).

In the reduction processing according to the second embodiment, the blue light in an image corresponding to the image information Sin is reduced by color adjustment processing as the display apparatus D2 without separately using the special optical component described above in the same manner as in the reduction processing according to the first embodiment.

Specifically, as illustrated in FIG. 12(*a*), in a case where the horizontal axis represents an input pixel value and the vertical axis represents an output pixel value, in the reduction processing according to the second embodiment, for an original image indicated by a dashed line in FIG. 12(*a*) (that is, an image corresponding to the image information Sin), the luminance of each color component in the hue axis H (see FIGS. 8(*a*) and 8(*b*) or FIGS. 9(*a*) and 9(*b*)) is updated by the pixel value update unit 60 so that the reduction rate of B component in the hue axis H is greater than or equal to the reduction rates of the other color components in the hue axis H and the updated image is output to the switching unit 7 as the update image information Sbc. At this time, a case in which the reduction rate of B component in the hue axis H is the same as the reduction rates of the other color components in the hue axis H corresponds to the principle described using FIG. 9(*a*). On the other hand, a case in which the reduction rate of B component in the hue axis H is greater than the reduction rates of the other color components in the hue axis H or a case in which only the B component in the hue axis H is reduced corresponds to the principle described using FIG. 9(*b*). For example, these reduction processing are performed for each pixel. When the reduction processing illustrated in FIG. 12(*a*) is represented in an HLS color space, for example, the result is as illustrated in FIG. 12(*b*). As it is clear from FIG. 12(*b*), in a case where only the B component in the hue axis H is reduced in the reduction processing according to the second embodiment, the color components other than the B component in the hue axis H are not reduced. In this case, the color components other than the B component may also be reduced by using a reduction rate smaller than that of the B component.

In the recording unit 5 of the display apparatus D2 according to the second embodiment, for example, as illustrated in FIG. 11, the reduction rate tables, which include reduction rate parameters indicating purpose of the reduction processing according to the second embodiment illustrated in FIGS. 12(*a*) and 12(*b*) for different reduction rates, respectively, are recorded in advance as a first reduction rate table TT1, a second reduction rate table TT2, a third reduction rate table TT3, . . . , and an nth reduction rate table TTn. At this time, regarding differences of the reduction rates between the reduction rate tables, for example, as described by using FIG. 3 in the first embodiment, the reduction rates according to the purpose illustrated in FIGS. 12(*a*) and 12(*b*) are recorded in advance for each color component so that the greater the serial number of the reduction rate table is, the greater the reduction rate is. It is considered that the actual values of the reduction rate parameters in each reduction rate table are determined in advance by, for example, experiment or experience.

Next, the reduction processing according to the second embodiment will be described more specifically with reference to FIG. 13.

As shown in FIG. 13, in the reduction processing according to the second embodiment, first, steps S1 to S3 that are the same as those of the reduction processing according to the first embodiment are performed.

Subsequently, for example, in a case where the range specification signal from the operation unit 2 indicates that pixels included in the same range AR as the range AR illustrated in FIG. 5(*a*) in the first embodiment are objects of the reduction processing according to the second embodiment (step S3; YES), the correction target range setting unit 4 outputs the image information Sin of the pixels in the range AR to the color space conversion unit 61. On the other hand (step S3; NO), the correction target range setting unit 4 outputs the image information Sin of pixels other than the pixels in the range AR to the switching unit 7 directly (step S6). Further, in this case, in the same manner as illustrated in FIG. 5(*b*) in the first embodiment, it is possible to configure so that a range AR including an image that is not an object of the reduction processing according to the second embodiment is specified by the range specification signal from the operation unit 2 and pixels included in a range other than the range AR are set to be objects of the reduction processing according to the second embodiment.

Subsequently, the color space conversion unit 61 performs the conversion processing from the RGB color space to the HLS color space described above on the image information Sin output from the correction target range setting unit 4 and outputs the image information Sin where the color space is converted to the HLS color space to the pixel value update unit 60 (step S10).

In parallel with these, in the recording unit 5, selection of the reduction rate table indicated by the table specification signal from the operation unit 2 (in other words, specification of the reduction rate) is performed (step S11) and a reduction rate parameter included in the reduction rate table specified by the table specification signal is output to the pixel value update unit 60.

Thereby, the pixel value update unit 60 updates at least a pixel value of the B component in the hue axis H in each pixel included in the image information Sin output from the color space conversion unit 61 to a pixel value indicated by the reduction rate table output from the recording unit 5 (step S12) and outputs the updated pixel values to the color space reverse conversion unit 62 as the update image information Sbc.

Then, the color space reverse conversion unit 62 performs the reverse conversion processing from the HLS color space to the RGB color space described above on the update image information Sbc output from the pixel value update unit 60 and outputs the update image information Sbc where the color space is returned to the RGB color space to the switching unit 7 (step S13).

Thereafter, the switching unit 7 switches between the blue light reduction control unit 3 or the correction target range setting unit 4 and the color space reverse conversion unit 62 based on the ON/OFF signal and the range specification signal from the operation unit 2 and outputs the display information Sout to the display 8 to cause the display 8 to display the display information Sout (step S6).

As described above, according to the reduction processing according to the second embodiment, the update image information Sbc is generated and displayed by reducing the luminance corresponding to the B component so that the reduction rate of the luminance corresponding to the B component in the HLS color space is greater than or equal to the reduction rate of each luminance corresponding to each of the color components other than the B component in the hue axis H. Therefore, it is possible to reduce the harmful B component without separately using an optical member or the like that reduces the B component.

Further, as illustrated in FIG. 9(*a*), in a case where an image corresponding to the image information Sin is achromatic color, if the update image information Sbc is generated by reducing the luminance only on the luminance axis L (in other words, by setting the saturation on the saturation axis S is set to zero), it is possible to effectively protect eyes from an achromatic color image, for example, a white color image. Further, even in a case where the saturation of an image corresponding to the image information Sin is, for example, smaller than or equal to 10%, if the update image information Sbc is generated by setting all the reduction rates of luminance corresponding to the B component in the hue and the color components other than the B component to be substantially the same, all the color components in the hue are substantially evenly reduced, so that, for example, it is possible to reduce the B component while preventing color tone of white color on display from being changed and it is possible to reduce the harmful B component without change of color tone.

Further, as illustrated in FIG. 9(*b*), in a case where generating display image information by reducing only the luminance corresponding to the B component in the hue, it is possible to reduce the harmful B component while preventing the color tone of color including white color on display from being changed.

Regarding the reduction processing according to the second embodiment described above, a case in which the HLS color space is used as a color space is described. However, even in a case where the HSV color space described with reference to FIGS. 8(*a*) to 10(*b*) is used, it is possible to perform the reduction processing according to the second embodiment in exactly the same manner. In this case, the color space conversion unit 61 performs conversion processing from the RGB color space to the HSV color space for the image information Sin, and the color space reverse conversion unit 62 performs reverse conversion processing from the HSV color space to the RGB color space for the update image information Sbc. The update of pixel value in this case is an update of pixel value based on the principle illustrated in FIGS. 10(*a*) and 10(*b*). The conversion processing from the RGB color space to the HSV color space in the color space conversion unit 60 and the reverse conversion processing from the HSV color space to the RGB color space in the color space reverse conversion unit 62 are the same as conventional conversion processing and conventional reverse conversion processing, respectively. As described above, in the reduction processing according to the second embodiment, the reduction processing is performed by converting the color space of the image information Sin to either one of the HLS color space and the HSV color space, so that it is possible to reduce the harmful B component while preventing the color tone on display of color including white color from being changed. Further, the present invention can also be applied to a so-called La*b* color space which is a similar color space and a so-called YCbCr (YUV) color space which comprises luminance and color difference.

Further, regarding a point where the reduction processing is performed by using a reduction rate table selected by an operation of the operation unit 2 from among the reduction rate tables recorded in the recording unit 5 and a point where a range to be an object of the reduction processing according to the second embodiment can be selected, these points can achieve the same effects as those of the reduction processing according to the first embodiment, respectively, and further, the same applications as those of the reduction processing according to the first embodiment can be performed.

Furthermore, as the reduction processing according to the second embodiment, it is possible to implement modes other than the embodiment described above.

Figure 14:
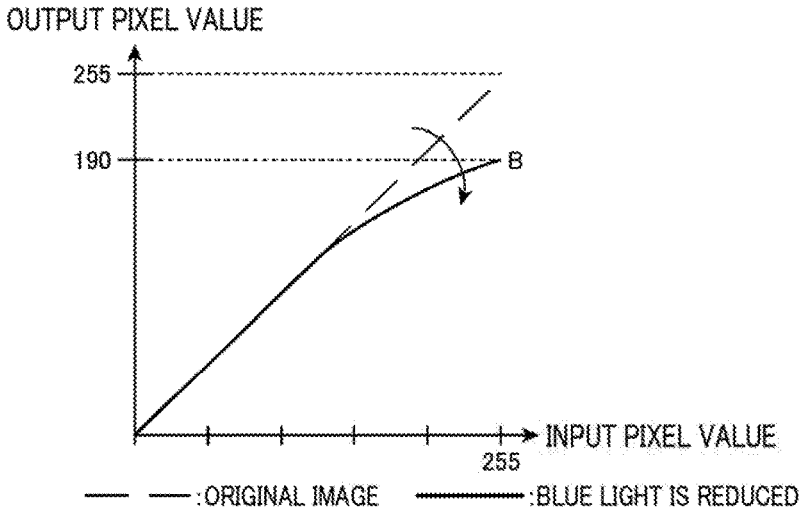
FIGS. 14(*a*) and 14(*b*) are figures showing another example of the reduction processing of blue light according to the second embodiment, FIG. 14(*a*) is a figure showing differences between luminance values of colors, and FIG. 14(*b*) is a figure explaining reduction of blue light in hue of the HLS color space.
Figure 14:
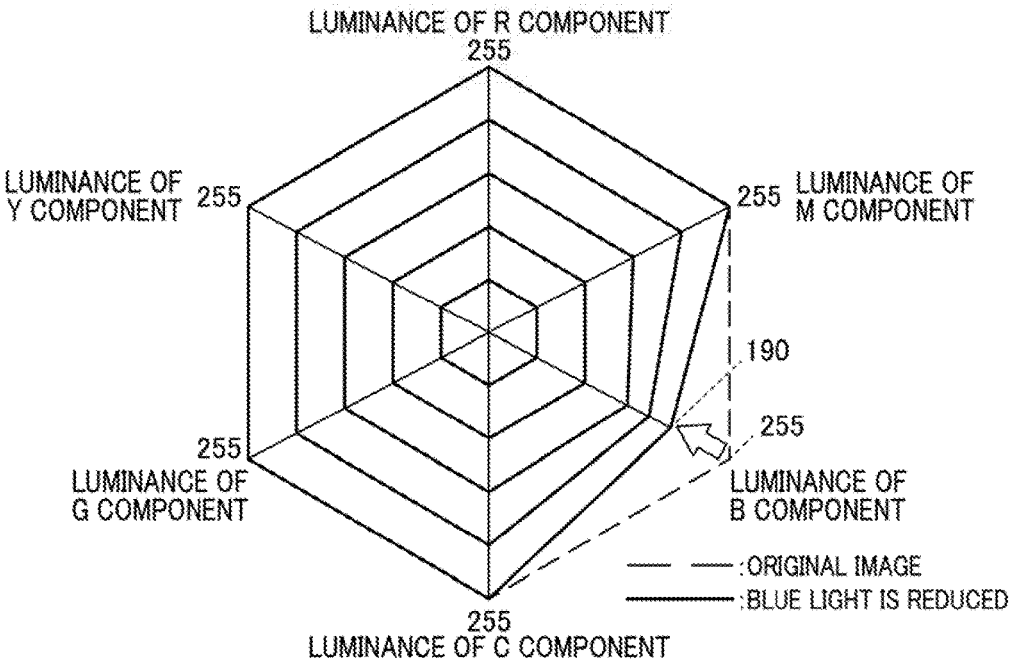

For example, in the second embodiment, described above, for example, a case is described in which the reduction rate of the B component of the hue axis H is linearly changed as illustrated using FIGS. 12(*a*) and 12(*b*). However, in addition to the above, for example, as illustrated in FIG. 14(*a*), it is possible to configure so that the greater the luminance in the input image information Sin is, the greater the reduction rate is. In this case, when the reduction processing illustrated in FIG. 14(*a*) is represented in an HLS color space, for example, as illustrated in FIG. 14(*b*), the reduction rates change unevenly. Such reduction processing can be realized by changing the content of reduction rate parameters included in the reduction rate tables according to the second embodiment.

Further, it is possible to configure so that the blue light reduction control unit 3 detects an average luminance in the entire image to be displayed and the reduction processing according to the first embodiment or the reduction processing according to the second embodiment is performed when the detected average luminance is greater than or equal to a luminance that is set in advance by, for example, experiment or experience. In this case, the reduction processing is performed when the average luminance in the entire image is greater than or equal to a predetermined luminance, so that it is possible to reduce the harmful blue light without damaging color tone, feeling, or the like of the entire image. Further, it is possible to configure so that the luminance at this time is detected by, for example, separately providing an illuminance sensor that detects an illuminance on the surface of the display 8.

Further, in the first embodiment and the second embodiment described above, a range in an image is specified as an object and whether or not to perform the reduction processing according to the first embodiment or the reduction processing according to the second embodiment on the object is controlled. However, it is possible to omit the range specification processing and perform the reduction processing according to the first embodiment or the reduction processing according to the second embodiment on the entire image uniformly. Furthermore, it is possible to configure so that a user can specify the reduction rates every time in detail instead of recording the reduction rates in advance as in the reduction tables according to each embodiment.

Furthermore, in the first embodiment and the second embodiment described above, the blue light is reduced by controlling, for example, the reduction rate of luminance corresponding to a color component. However, in this context, the present invention can be applied to a case in which the blue light is reduced by controlling the amount of reduction of the luminance. In this case, more specifically, the present invention can be applied in the same manner by, for example, controlling the amount of reduction to have the following relationship.

Reduction rate [%]=(amount of reduction/input pixel value)×100

Further, by recording a program corresponding to the flowchart shown in FIG. 4 or 13 in a recording medium such as an optical disk or acquiring the program through a network such as the Internet and recording the program, and causing, for example, a general-purpose microcomputer to read and execute the program, it is possible to cause the microcomputer or the like to function as the blue light reduction control unit 3, the correction target range setting unit 4, the pixel value update unit 6 (the pixel value update unit 60), and the switching unit 7 according to the first embodiment or the second embodiment.

EXAMPLES

Figure 15:
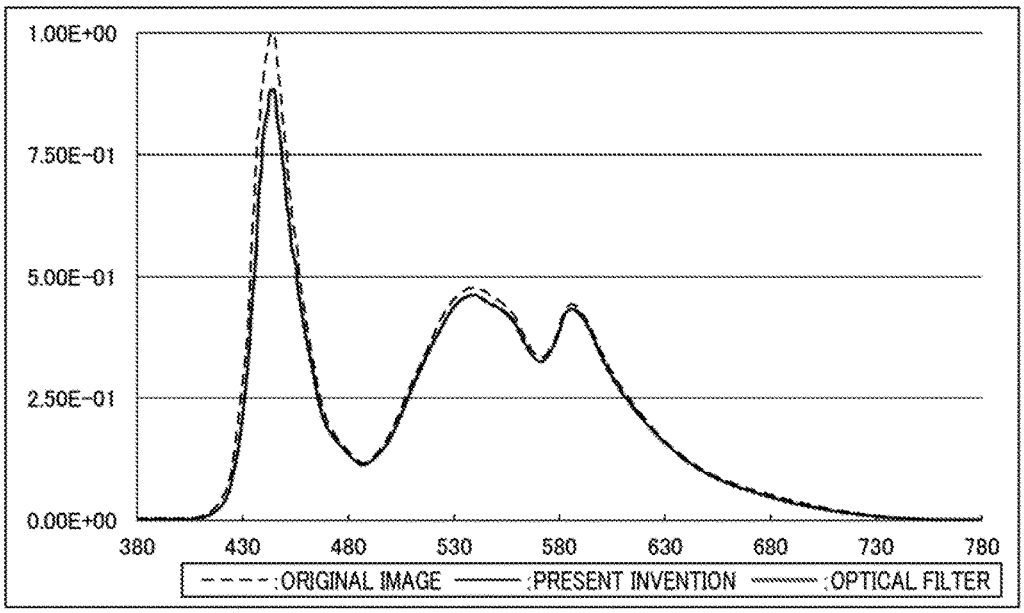
FIGS. 15(*a*) and 15(*b*) are figures (I) illustrating effects of the present invention, FIG. 15(*a*) is a figure illustrating the effect over a wide range of wavelength, and FIG. 15(*b*) is a figure illustrating the effect for wavelength of blue light.
Figure 15:
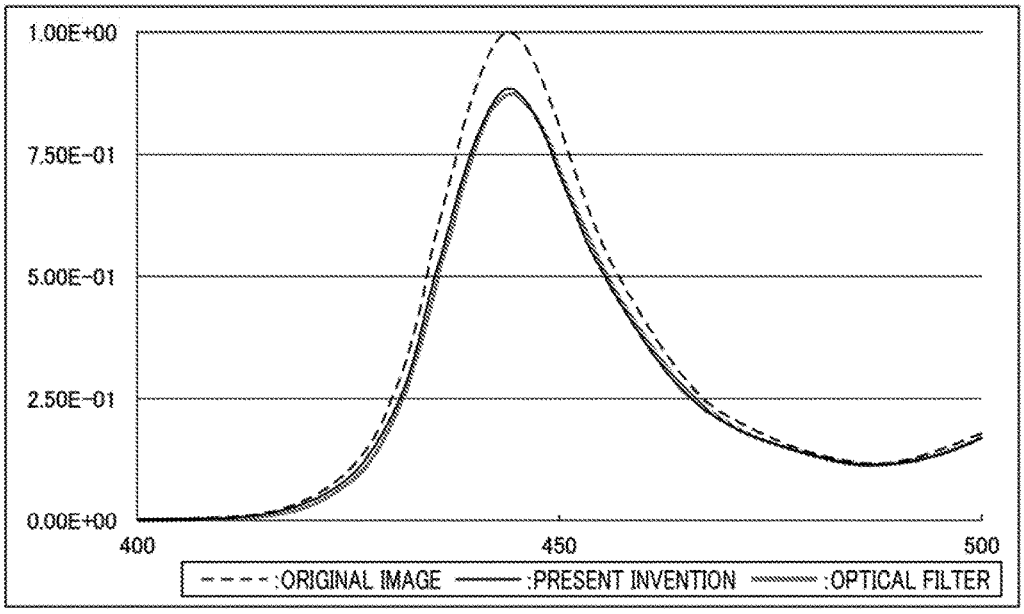

Next, experimental results and the like where the effects of the reduction processing according to the first embodiment of the embodiments described above are verified will be described with reference to FIGS. 15(*a*) to 17(*b*). FIGS. 15(*a*) to 17(*b*) are figures illustrating the effects. The experimental results and the like described below can be applied to the reduction processing according to the second embodiment.

First, an overview of an experiment performed to confirm the effects of the reduction processing according to the first embodiment will be described. In the experiment of which result will be described below, as an image, white (for example, in an RGB 24-bit color space (eight bits for each color), the values of luminance of the colors are "255, 255, 255") is displayed and energy irradiated from the display 8 is observed by a spectral radiance meter in three cases respectively, which are a case in which both of an optical filter corresponding to the optical component described in Background Art and the present invention are not used ("original image" in the description below and FIGS. 15(*a*) to 17(*b*)), a case in which the blue light is reduced by using only the optical filter ("optical filter" in the description below and FIGS. 15(*a*) to 17(*b*)), and a case in which the blue light is reduced by applying the present invention and not using the optical filter ("present invention" in the description below and FIGS. 15(*a*) to 17(*b*)). In FIGS. 15(*a*) to 17(*b*), the horizontal axis represents a wavelength and the vertical axis represents a normalized value of a value of measured radiance. In FIGS. 15(*a*) to 17(*b*), FIGS. 15(*a*), 16(*a*), and 17(*a*) show the values at all wavelengths, and FIGS. 15(*b*), 16(*b*), and 17(*b*) enlarge and show the values of B component.

First, as illustrated in FIGS. 15(*a*) and 15(*b*), in a case where the reduction rate is relatively small, as illustrated in each of FIGS. 15(*a*) and 15(*b*), in the reduction processing according to the first embodiment, a reduction effect of blue light can be realized in the same manner as that of the optical filter.

Figure 16:
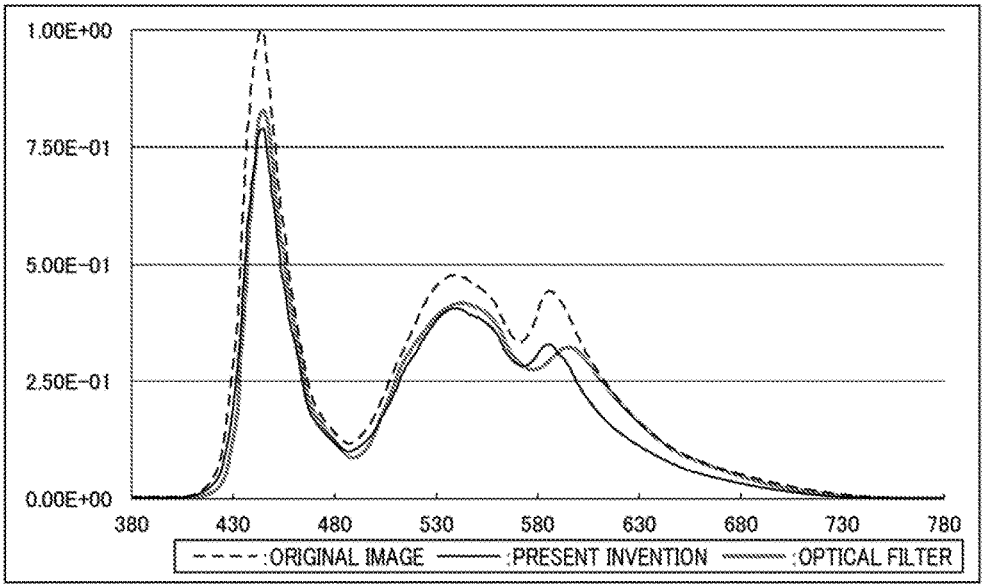
FIGS. 16(*a*) and 16(*b*) are figures (II) illustrating effects of the present invention, FIG. 16(*a*) is a figure illustrating the effect over a wide range of wavelength, and FIG. 16(*b*) is a figure illustrating the effect for wavelength of blue light.
Figure 16:
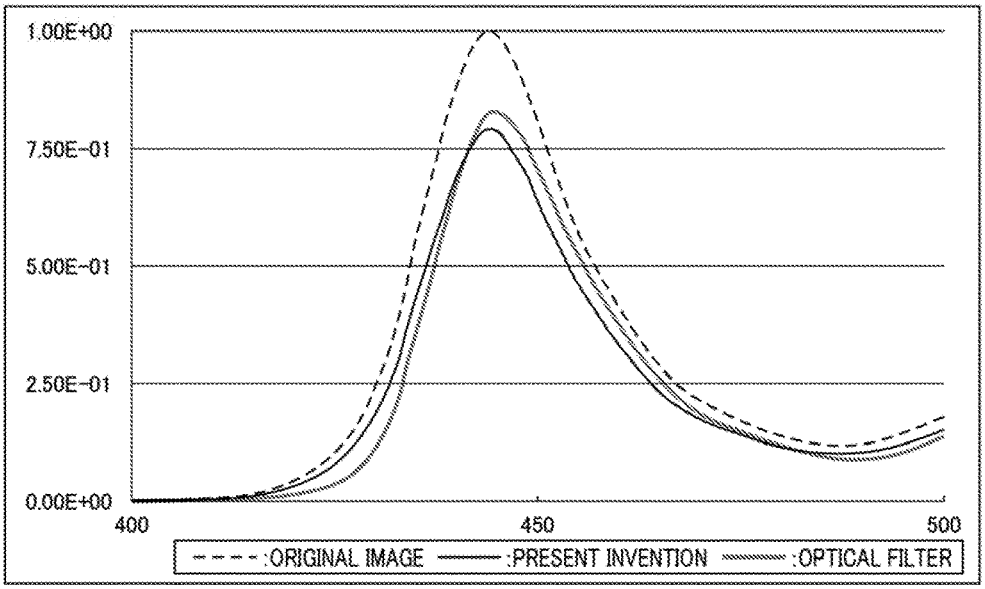

On the other hand, as illustrated in FIGS. 16(*a*) and 16(*b*), in a case where the reduction rate is relatively large, as illustrated in each of FIGS. 16(*a*) and 16(*b*), although there is some variation in the measurement result, the variation is not so large and can be sufficiently alleviated by optimizing a parameter used when adjusting color.

By the experiments of which results are shown in FIGS. 15(*a*) to 16(*b*), even in a case where an optical filter of which characteristics are different is used, the reduction of blue light which is similar to that of the optical filter can be realized by changing the reduction parameters according to the first embodiment. In other words, a user can arbitrarily control the reduction rate by adjusting the reduction parameters.

Figure 17:
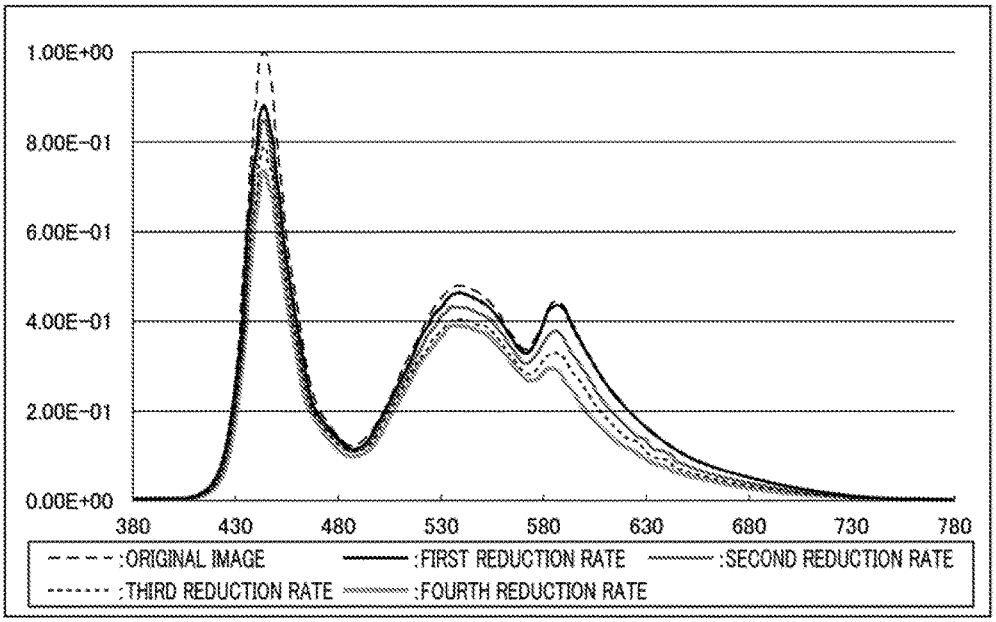
FIGS. 17(*a*) and 17(*b*) are figures (III) illustrating effects of the present invention, FIG. 17(*a*) is a figure illustrating the effect over a wide range of wavelength, and FIG. 17(*b*) is a figure illustrating the effect for wavelength of blue light.
Figure 17:
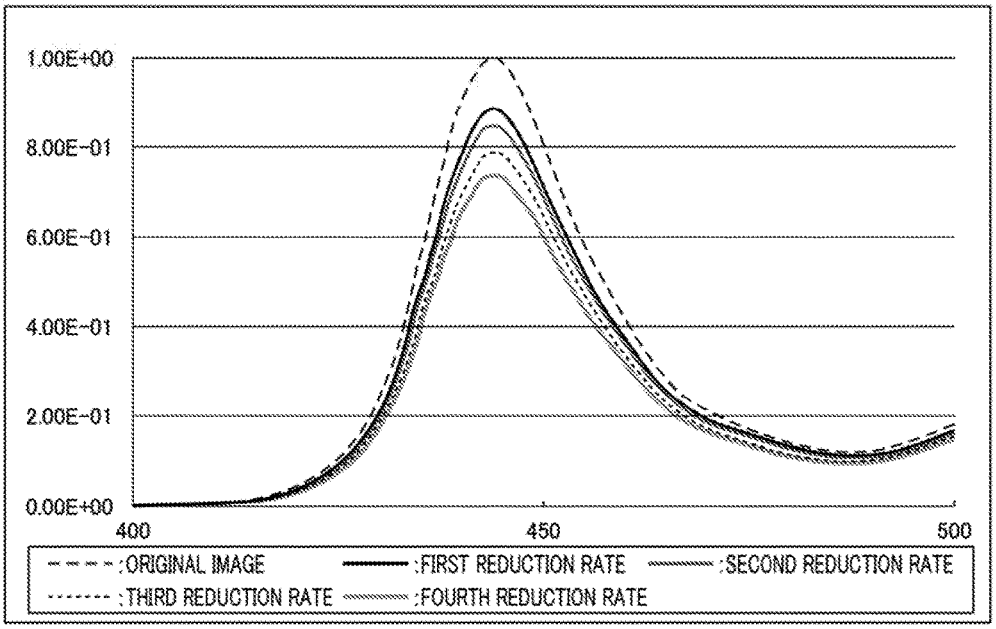

Finally, as illustrated in FIGS. 17(*a*) and 17(*b*), the experiment is performed by using four kinds of reduction parameters (a first parameter to a fourth parameter). Regarding the reduction parameters, the same reduction parameters as those illustrated in FIG. 3 are used. As it is clear from FIGS. 17(*a*) and 17(*b*), it is possible to realize any reduction rate of blue light by changing the reduction parameters for color adjustment. As a result, a user can arbitrarily control the reduction rate, so that it is possible to deal with a request for reduction rate different for each situation and each individual person.

INDUSTRIAL APPLICABILITY

As described above, the present invention can be used in a field of display apparatus and if the present invention is applied to a field of control of display apparatus to protect user's eyes, a particularly remarkable effect can be obtained.

EXPLANATION OF REFERENCE NUMERALS

1 Image generation unit
2 Operation unit
3 Blue light reduction control unit
4 Correction target range setting unit
5 Recording unit
6, 60 Pixel value update unit
61 Color space conversion unit
62 Color space reverse conversion unit
7 Switching unit
8 Display
D1, D2 Display apparatus
AR Range
Sin Image information
Sop Operation signal
Sbc Update image information
Sout Display information
T1, TT1 First reduction rate table
TT2 Second reduction rate table
T3 TT3 Third reduction rate table
Tn, TTn nth reduction rate table

The invention claimed is:

1. An image processing apparatus comprising:

an acquisition means that acquires image information corresponding to an image to be displayed on a display means, the image including at least an image of a document; and processing means that performs luminance control processing that generates display image information by reducing at least luminance corresponding to a blue component in the acquired image information, the luminance control processing including reduction processing performed for each pixel of the image information so that a reduction rate of the luminance corresponding to the blue component in the acquired image information is greater than or equal to reduction rates of luminance corresponding to the other color components in the acquired image information and outputs the display image information to the display means to cause the display means to display the display image information;

wherein the reduction rate [%]=(1−(output pixel value/input pixel value))×100, assuming that each pixel value of the image information is 1 when the reduction processing is not performed;

wherein the display means acquires the display image information and displays the image corresponding to the display image information on an entire area of the display means; and wherein the respective reduction rates in the acquired image information are different from a reduction rate of energy generated by the display.

2. The image processing apparatus according to claim 1, wherein the blue component is a B component in an RGB (Red Green Blue) color space and the other color components are an R component and a G component in the RGB color space; and wherein the processing means generates the display image information by reducing the luminance corresponding to the B component so that the reduction rate of the luminance corresponding to the B component is greater than the reduction rates of the luminance respectively corresponding to the R component and the G component and outputs the display image information to the display means to cause the display means to display the display image information.

3. The image processing apparatus according to claim 2, wherein as the luminance control processing, the processing means generates the display image information by setting, the greater the B component in a pixel included in the image is than the R component and the G component in the pixel, the greater the reduction rate of the luminance corresponding to the B component.

4. The image processing apparatus according to claim 2, wherein as the luminance control processing, the processing means generates the display image information by setting the reduction rates of the luminance respectively corresponding to the R component and the G component to be greater than or equal to a quarter and smaller than or equal to a half of the reduction rate of the luminance corresponding to the B component.

5. The image processing apparatus according to claim 1, wherein the blue component is a B component in hue in a color space including three elements including the hue, and saturation and the other color components are color components other than the B component in the hue; and wherein the processing means generates the display image information by reducing the luminance corresponding to the B component so that the reduction rate of the luminance corresponding to the B component is greater than or equal to the reduction rates of the luminance corresponding to the color components other than the B component in the hue and outputs the display image information to the display means to cause the display means to display the display image information.

6. The image processing apparatus according to claim 5, wherein as the luminance control processing, the processing means generates the display image information by setting all of the reduction rates of the luminance respectively corresponding to the B component in the hue and the color components other than the B component in the hue to be the same.

7. The image processing apparatus according to claim 5, wherein when an image corresponding to the acquired image information is achromatic color, as the luminance control processing, the processing means generates the display image information by reducing only an element other than the hue and the saturation in the color space.

8. The image processing apparatus according to claim 5, wherein as the luminance control processing, the processing means generates the display image information by reducing only the luminance corresponding to the B component in the hue.

9. The image processing apparatus according to claim 5, wherein the color space is either one of an HLS (Hue, Luminance, Saturation) color space and an HSV (Hue, Saturation, Value) color space.

10. The image processing apparatus according to claim 1, further comprising detection means that detects an average luminance in the entire image to be displayed;

wherein when the detected average luminance is greater than or equal to a previously set luminance, the processing means performs the luminance control processing.

11. The image processing apparatus according to claim 1, wherein the processing means comprises:

storage means that previously stores luminance information indicating at least the reduction rate of the luminance corresponding to the B component for the luminance control processing; and selection means that is used to cause the stored luminance information to be selected;

wherein the processing means performs the luminance control processing by using the selected luminance information.

12. A display apparatus comprising:

the image processing apparatus according to claim 1; and display means that acquires the display image information and displays an image corresponding to the display image information on an entire area of the display means.

13. An image processing method comprising:

providing display means;

performing an acquisition step of acquiring image information corresponding to an image to be displayed on the display means, the image including at least an image of a document; and performing a processing step of generating display image information by reducing at least luminance corresponding to a blue component in the acquired image information, including luminance control processing comprising reduction processing performed for each pixel of the image, so that a reduction rate of the luminance corresponding to the blue component in the acquired image information is greater than or equal to reduction rates of luminance corresponding to the other color components in the acquired image information and outputting the display image information to the display means to cause the display means to display the display image information;

wherein the reduction rate [%]=(1−(output pixel value/input pixel value))×100, assuming that each pixel value of the image is 1 when the reduction processing is not performed;

wherein the display means acquires the display image information and displays the image corresponding to the display image information on an entire area of the display means; and wherein the respective reduction rates in the acquired image information are different from a reduction rate of energy generated by the display.

14. An image processing program causing a computer included in an image processing apparatus to function as:

an acquisition means that acquires image information corresponding to an image to be displayed on a display means, the image including at least an image of a document; and a processing means that generates display image information by reducing at least luminance corresponding to a blue component in the acquired image information, the processing means including luminance control processing comprising reduction processing performed for each pixel of the image information, so that a reduction rate of the luminance corresponding to the blue component in the acquired image information is greater than or equal to reduction rates of luminance corresponding to the other components in the acquired image information, wherein the reduction rate [%]=(1−(output pixel value/input pixel value))×100, assuming that each pixel value of the image information is 1 when the reduction processing is not performed, and outputs the display image information to the display means to cause the display means to display the display image information over an entire area of the display means, and wherein the respective reduction rates in the acquired image information are different from a reduction rate of energy generated by the display.

* * * * *